US011891890B2

(12) United States Patent
Meehan et al.

(10) Patent No.: US 11,891,890 B2
(45) Date of Patent: Feb. 6, 2024

(54) DRILLING CONTROL

(71) Applicant: Schlumberger Technology Corporation, Sugar Land, TX (US)

(72) Inventors: Richard Meehan, Houston, TX (US); James Belaskie, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 26 days.

(21) Appl. No.: 17/758,034

(22) PCT Filed: Dec. 18, 2020

(86) PCT No.: PCT/US2020/065789

§ 371 (c)(1),
(2) Date: Jun. 27, 2022

(87) PCT Pub. No.: WO2021/133641

PCT Pub. Date: Jul. 1, 2021

(65) Prior Publication Data

US 2023/0012511 A1 Jan. 19, 2023

Related U.S. Application Data

(60) Provisional application No. 62/954,349, filed on Dec. 27, 2019.

(51) Int. Cl.

| | |
|---|---|
| ***E21B 44/00*** | (2006.01) |
| ***E21B 47/12*** | (2012.01) |
| ***E21B 47/04*** | (2012.01) |

(52) U.S. Cl.

CPC ..... *E21B 47/12* (2013.01); *E21B 44/00* (2013.01); *E21B 47/04* (2013.01)

(58) Field of Classification Search

CPC ..... E21B 47/12; E21B 44/00; E21B 47/04

See application file for complete search history.

(56) References Cited

U.S. PATENT DOCUMENTS 3,643,504 A 2/1972 Rundell
5,107,705 A * 4/1992 Wraight ..... E21B 45/00 702/9

(Continued)

FOREIGN PATENT DOCUMENTS

EP 0449710 A2 10/1991
WO 2017070025 A1 4/2017
WO 2018058214 A1 4/2018

OTHER PUBLICATIONS

Search Report and Written Opinion of International Patent Application No. PCT/US2020/065789 dated Apr. 8, 2021, 8 pages.

(Continued)

*Primary Examiner* — Taras P Bemko
(74) *Attorney, Agent, or Firm* — Jeffrey D. Frantz

(57) ABSTRACT

A method can include receiving block position data of a rig prior to addition of a length of pipe to a drillstring, where the drillstring is disposed at least in part in a borehole and supported by the rig; receiving block position data of the rig after addition of the length of pipe to the drillstring; and controlling position of the drillstring with respect to time using the rig and at least a portion of the block position data for landing a drill bit of the drillstring on a bottom of the borehole.

20 Claims, 14 Drawing Sheets

(56) References Cited

U.S. PATENT DOCUMENTS

| | | | | |
|---|---|---|---|---|
| 5,202,680 | A * | 4/1993 | Savage | E21B 47/017 342/44 |
| 2003/0006071 | A1 | 1/2003 | Stump et al. | |
| 2008/0105427 | A1* | 5/2008 | Hampton | E21B 19/00 166/64 |
| 2016/0369617 | A1* | 12/2016 | Zheng | E21B 47/04 |
| 2017/0167853 | A1 | 6/2017 | Zheng et al. | |
| 2017/0328193 | A1* | 11/2017 | Holt | E21B 12/02 |
| 2019/0004882 | A1 | 1/2019 | Martin et al. | |
| 2019/0136650 | A1 | 5/2019 | Zheng et al. | |

OTHER PUBLICATIONS

Extended Search Report issued in European Patent Application No. 20905127.5 dated Nov. 15, 2023, 6 pages.

* cited by examiner

| x | y | Depth | Pad Config. | Pad Orient. | Well Length | Vertical Spacing | Horiz. Spacing | Toe Height | Step Out | Initial Incl. | Kick Off |
|---|---|---|---|---|---|---|---|---|---|---|---|
| 11 | 93 | 217 | 2 | 90 | 2000 | 50 | 500 | 0 | 1000 | 0 | 0 |
| 11 | 94 | 384 | 1 | 90 | 1000 | 50 | 500 | 0 | 1000 | 0 | 0 |
| 12 | 95 | 282 | 1 | 90 | 1000 | 50 | 500 | 0 | 1000 | 0 | 0 |

Method 900

DRILLING CONTROL

RELATED APPLICATIONS

This application is a National Stage Entry of International Application No. PCT/US2020/065789, filed 18 Dec. 2020, which claims priority to and the benefit of a U.S. Provisional Application having Ser. No. 62/954,349, filed 27 Dec. 2019, each of which is incorporated by reference herein.

BACKGROUND

A resource field can be an accumulation, pool or group of pools of one or more resources (e.g., oil, gas, oil and gas) in a subsurface environment. A resource field can include at least one reservoir. A reservoir may be shaped in a manner that can trap hydrocarbons and may be covered by an impermeable or sealing rock. A bore (e.g., a borehole) can be drilled into an environment where the bore may be utilized to form a well that can be utilized in producing hydrocarbons from a reservoir.

A rig can be a system of components that can be operated to form a bore in an environment, to transport equipment into and out of a bore in an environment, etc. As an example, a rig can include a system that can be used to drill a bore and to acquire information about an environment, about drilling, etc. A resource field may be an onshore field, an offshore field or an on- and offshore field. A rig can include components for performing operations onshore and/or offshore. A rig may be, for example, vessel-based, offshore platform-based, onshore, etc.

Field planning and/or development can occur over one or more phases, which can include an exploration phase that aims to identify and assess an environment (e.g., a prospect, a play, etc.), which may include drilling of one or more bores (e.g., one or more exploratory wells, etc.). As mentioned, for purposes of production, a bore can be drilled using a rig and completed to form a producing well.

SUMMARY

A method can include receiving block position data of a rig prior to addition of a length of pipe to a drillstring, where the drillstring is disposed at least in part in a borehole and supported by the rig; receiving block position data of the rig after addition of the length of pipe to the drillstring; and controlling position of the drillstring with respect to time using the rig and at least a portion of the block position data for landing a drill bit of the drillstring on a bottom of the borehole. A system can include a processor; memory accessible by the processor; processor-executable instructions stored in the memory and executable to instruct the system to: receive block position data of a rig prior to addition of a length of pipe to a drillstring, where the drillstring is disposed at least in part in a borehole and supported by the rig; receive block position data of the rig after addition of the length of pipe to the drillstring; and control position of the drillstring with respect to time using the rig and at least a portion of the block position data for landing a drill bit of the drillstring on a bottom of the borehole. One or more computer-readable storage media can include processor-executable instructions to instruct a computing system to: receive block position data of a rig prior to addition of a length of pipe to a drillstring, where the drillstring is disposed at least in part in a borehole and supported by the rig; receive block position data of the rig after addition of the length of pipe to the drillstring; and control position of the drillstring with respect to time using the rig and at least a portion of the block position data for landing a drill bit of the drillstring on a bottom of the borehole. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

DETAILED DESCRIPTION

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

Figure 1:
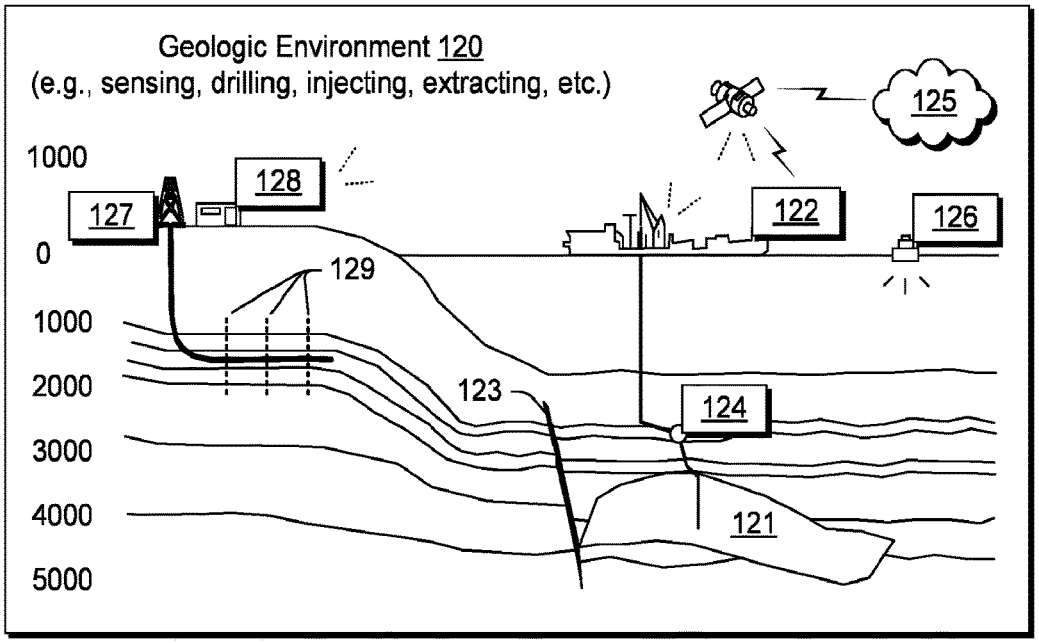
FIG. 1 illustrates examples of equipment in a geologic environment.
Figure 1:
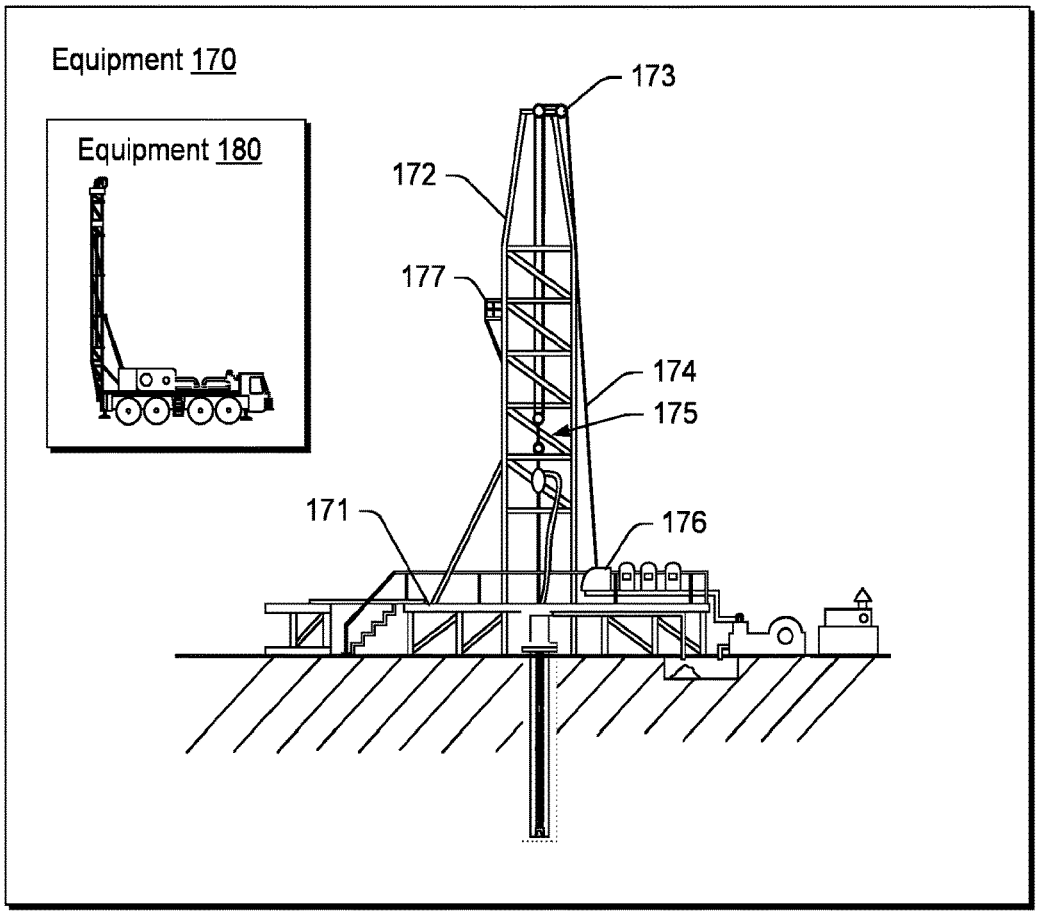

FIG. 1 shows an example of a geologic environment 120. In FIG. 1, the geologic environment 120 may be a sedimentary basin that includes layers (e.g., stratification) that include a reservoir 121 and that may be, for example, intersected by a fault 123 (e.g., or faults). As an example, the geologic environment 120 may be outfitted with any of a variety of sensors, detectors, actuators, etc. For example, equipment 122 may include communication circuitry to receive and to transmit information with respect to one or more networks 125. Such information may include information associated with downhole equipment 124, which may be equipment to acquire information, to assist with resource recovery, etc. Other equipment 126 may be located remote from a well site and include sensing, detecting, emitting or other circuitry. Such equipment may include storage and communication circuitry to store and to communicate data, instructions, etc. As an example, one or more pieces of equipment may provide for measurement, collection, communication, storage, analysis, etc. of data (e.g., for one or more produced resources, etc.). As an example, one or more satellites may be provided for purposes of communications, data acquisition, etc. For example, FIG. 1 shows a satellite in communication with the network 125 that may be configured for communications, noting that the satellite may additionally or alternatively include circuitry for imagery (e.g., spatial, spectral, temporal, radiometric, etc.).

FIG. 1 also shows the geologic environment 120 as optionally including equipment 127 and 128 associated with a well that includes a substantially horizontal portion (e.g., a lateral portion) that may intersect with one or more fractures 129. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop the reservoir (e.g., via fracturing, injecting, extracting, etc.). As an example, the equipment 127 and/or 128 may include components, a system, systems, etc. for fracturing, seismic sensing, analysis of seismic data, assessment of one or more fractures, injection, production, etc. As an example, the equipment 127 and/or 128 may provide for measurement, collection, communication, storage, analysis, etc. of data such as, for example, production data (e.g., for one or more produced resources). As an example, one or more satellites may be provided for purposes of communications, data acquisition, etc.

FIG. 1 also shows an example of equipment 170 and an example of equipment 180. Such equipment, which may be systems of components, may be suitable for use in the geologic environment 120. While the equipment 170 and 180 are illustrated as land-based, various components may be suitable for use in an offshore system (e.g., an offshore rig, etc.).

The equipment 170 includes a platform 171, a derrick 172, a crown block 173, a line 174, a traveling block assembly 175, drawworks 176 and a landing 177 (e.g., a monkeyboard). As an example, the line 174 may be controlled at least in part via the drawworks 176 such that the traveling block assembly 175 travels in a vertical direction with respect to the platform 171. For example, by drawing the line 174 in, the drawworks 176 may cause the line 174 to run through the crown block 173 and lift the traveling block assembly 175 skyward away from the platform 171; whereas, by allowing the line 174 out, the drawworks 176 may cause the line 174 to run through the crown block 173 and lower the traveling block assembly 175 toward the platform 171. Where the traveling block assembly 175 carries pipe (e.g., casing, etc.), tracking of movement of the traveling block 175 may provide an indication as to how much pipe has been deployed.

A derrick can be a structure used to support a crown block and a traveling block operatively coupled to the crown block at least in part via line. A derrick may be pyramidal in shape and offer a suitable strength-to-weight ratio. A derrick may be movable as a unit or in a piece by piece manner (e.g., to be assembled and disassembled).

As an example, drawworks may include a spool, brakes, a power source and assorted auxiliary devices. Drawworks may controllably reel out and reel in line. Line may be reeled over a crown block and coupled to a traveling block to gain mechanical advantage in a "block and tackle" or "pulley" fashion. Reeling out and in of line can cause a traveling block (e.g., and whatever may be hanging underneath it), to be lowered into or raised out of a bore. Reeling out of line may be powered by gravity and reeling in by a motor, an engine, etc. (e.g., an electric motor, a diesel engine, etc.).

As an example, a crown block can include a set of pulleys (e.g., sheaves) that can be located at or near a top of a derrick or a mast, over which line is threaded. A traveling block can include a set of sheaves that can be moved up and down in a derrick or a mast via line threaded in the set of sheaves of the traveling block and in the set of sheaves of a crown block. A crown block, a traveling block and a line can form a pulley system of a derrick or a mast, which may enable handling of heavy loads (e.g., drillstring, pipe, casing, liners, etc.) to be lifted out of or lowered into a bore. As an example, line may be about a centimeter to about five centimeters in diameter as, for example, steel cable. Through use of a set of sheaves, such line may carry loads heavier than the line could support as a single strand.

As an example, a derrickman may be a rig crew member that works on a platform attached to a derrick or a mast. A derrick can include a landing on which a derrickman may stand. As an example, such a landing may be about 10 meters or more above a rig floor. In an operation referred to as trip out of the hole (TOH), a derrickman may wear a safety harness that enables leaning out from the work landing (e.g., monkeyboard) to reach pipe located at or near the center of a derrick or a mast and to throw a line around the pipe and pull it back into its storage location (e.g., fingerboards), for example, until it may be desirable to run the pipe back into the bore. As an example, a rig may include automated pipe-handling equipment such that the derrickman controls the machinery rather than physically handling the pipe.

As an example, a trip may refer to the act of pulling equipment from a bore and/or placing equipment in a bore. As an example, equipment may include a drillstring that can be pulled out of a hole and/or placed or replaced in a hole. As an example, a pipe trip may be performed where a drill bit has dulled or has otherwise ceased to drill efficiently and is to be replaced. As an example, a trip that pulls equipment out of a borehole may be referred to as pulling out of hole (POOH) and a trip that runs equipment into a borehole may be referred to as running in hole (RIH).

Figure 2:
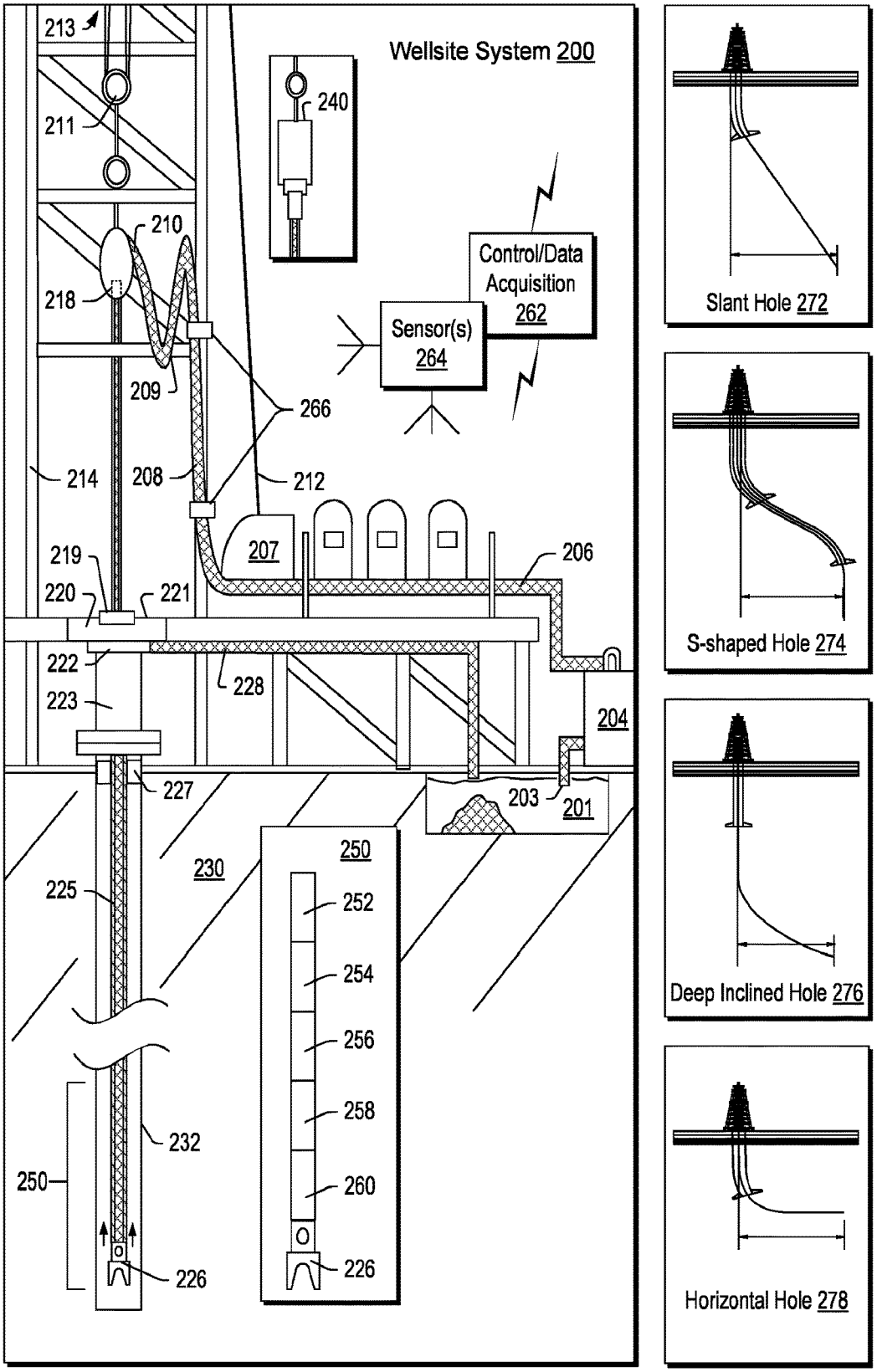
FIG. 2 illustrates examples of equipment and examples of hole types.

FIG. 2 shows an example of a wellsite system 200 (e.g., at a wellsite that may be onshore or offshore). As shown, the wellsite system 200 can include a mud tank 201 for holding mud and other material (e.g., where mud can be a drilling fluid), a suction line 203 that serves as an inlet to a mud pump 204 for pumping mud from the mud tank 201 such that mud flows to a vibrating hose 206, a drawworks 207 for winching drill line or drill lines 212, a standpipe 208 that receives mud from the vibrating hose 206, a kelly hose 209 that receives mud from the standpipe 208, a gooseneck or goosenecks 210, a traveling block 211, a crown block 213 for carrying the traveling block 211 via the drill line or drill lines 212 (see, e.g., the crown block 173 of FIG. 1), a derrick 214 (see, e.g., the derrick 172 of FIG. 1), a kelly 218 or a top drive 240, a kelly drive bushing 219, a rotary table 220, a drill floor 221, a bell nipple 222, one or more blowout preventors (BOPs) 223, a drillstring 225, a drill bit 226, a casing head 227 and a flow pipe 228 that carries mud and other material to, for example, the mud tank 201.

In the example system of FIG. 2, a borehole 232 is formed in subsurface formations 230 by rotary drilling; noting that various example embodiments may also use one or more directional drilling techniques, equipment, etc.

As shown in the example of FIG. 2, the drillstring 225 is suspended within the borehole 232 and has a drillstring assembly 250 that includes the drill bit 226 at its lower end. As an example, the drillstring assembly 250 may be a bottom hole assembly (BHA).

The wellsite system 200 can provide for operation of the drillstring 225 and other operations. As shown, the wellsite system 200 includes the traveling block 211 and the derrick 214 positioned over the borehole 232. As mentioned, the wellsite system 200 can include the rotary table 220 where the drillstring 225 pass through an opening in the rotary table 220.

As shown in the example of FIG. 2, the wellsite system 200 can include the kelly 218 and associated components, etc., or a top drive 240 and associated components. As to a kelly example, the kelly 218 may be a square or hexagonal metal/alloy bar with a hole drilled therein that serves as a mud flow path. The kelly 218 can be used to transmit rotary motion from the rotary table 220 via the kelly drive bushing 219 to the drillstring 225, while allowing the drillstring 225 to be lowered or raised during rotation. The kelly 218 can pass through the kelly drive bushing 219, which can be driven by the rotary table 220. As an example, the rotary table 220 can include a master bushing that operatively couples to the kelly drive bushing 219 such that rotation of the rotary table 220 can turn the kelly drive bushing 219 and hence the kelly 218. The kelly drive bushing 219 can include an inside profile matching an outside profile (e.g., square, hexagonal, etc.) of the kelly 218; however, with slightly larger dimensions so that the kelly 218 can freely move up and down inside the kelly drive bushing 219.

As to a top drive example, the top drive 240 can provide functions performed by a kelly and a rotary table. The top drive 240 can turn the drillstring 225. As an example, the top drive 240 can include one or more motors (e.g., electric and/or hydraulic) connected with appropriate gearing to a short section of pipe called a quill, that in turn may be screwed into a saver sub or the drillstring 225 itself. The top drive 240 can be suspended from the traveling block 211, so the rotary mechanism is free to travel up and down the derrick 214. As an example, a top drive 240 may allow for drilling to be performed with more joint stands than a kelly/rotary table approach.

In the example of FIG. 2, the mud tank 201 can hold mud, which can be one or more types of drilling fluids. As an example, a wellbore may be drilled to produce fluid, inject fluid or both (e.g., hydrocarbons, minerals, water, etc.).

In the example of FIG. 2, the drillstring 225 (e.g., including one or more downhole tools) may be composed of a series of pipes threadably connected together to form a long tube with the drill bit 226 at the lower end thereof. As the drillstring 225 is advanced into a wellbore for drilling, at some point in time prior to or coincident with drilling, the mud may be pumped by the pump 204 from the mud tank 201 (e.g., or other source) via a the lines 206, 208 and 209 to a port of the kelly 218 or, for example, to a port of the top drive 240. The mud can then flow via a passage (e.g., or passages) in the drillstring 225 and out of ports located on the drill bit 226 (see, e.g., a directional arrow). As the mud exits the drillstring 225 via ports in the drill bit 226, it can then circulate upwardly through an annular region between an outer surface(s) of the drillstring 225 and surrounding wall(s) (e.g., open borehole, casing, etc.), as indicated by directional arrows. In such a manner, the mud lubricates the drill bit 226 and carries heat energy (e.g., frictional or other energy) and formation cuttings to the surface where the mud (e.g., and cuttings) may be returned to the mud tank 201, for example, for recirculation (e.g., with processing to remove cuttings, etc.).

The mud pumped by the pump 204 into the drillstring 225 may, after exiting the drillstring 225, form a mudcake that lines the wellbore which, among other functions, may reduce friction between the drillstring 225 and surrounding wall(s) (e.g., borehole, casing, etc.). A reduction in friction may facilitate advancing or retracting the drillstring 225. During a drilling operation, the entire drillstring 225 may be pulled from a wellbore and optionally replaced, for example, with a new or sharpened drill bit, a smaller diameter drillstring, etc. As mentioned, the act of pulling a drillstring out of a hole or replacing it in a hole is referred to as tripping. A trip may be referred to as an upward trip or an outward trip or as a downward trip or an inward trip depending on trip direction.

As an example, consider a downward trip where upon arrival of the drill bit 226 of the drillstring 225 at a bottom of a wellbore, pumping of the mud commences to lubricate the drill bit 226 for purposes of drilling to enlarge the wellbore. As mentioned, the mud can be pumped by the pump 204 into a passage of the drillstring 225 and, upon filling of the passage, the mud may be used as a transmission medium to transmit energy, for example, energy that may encode information as in mud-pulse telemetry.

As an example, mud-pulse telemetry equipment may include a downhole device configured to effect changes in pressure in the mud to create an acoustic wave or waves upon which information may modulated. In such an example, information from downhole equipment (e.g., one or more modules of the drillstring 225) may be transmitted uphole to an uphole device, which may relay such information to other equipment for processing, control, etc.

As an example, telemetry equipment may operate via transmission of energy via the drillstring 225 itself. For example, consider a signal generator that imparts coded energy signals to the drillstring 225 and repeaters that may receive such energy and repeat it to further transmit the coded energy signals (e.g., information, etc.).

As an example, the drillstring 225 may be fitted with telemetry equipment 252 that includes a rotatable drive shaft, a turbine impeller mechanically coupled to the drive shaft such that the mud can cause the turbine impeller to rotate, a modulator rotor mechanically coupled to the drive shaft such that rotation of the turbine impeller causes said modulator rotor to rotate, a modulator stator mounted adjacent to or proximate to the modulator rotor such that rotation of the modulator rotor relative to the modulator stator creates pressure pulses in the mud, and a controllable brake for selectively braking rotation of the modulator rotor to modulate pressure pulses. In such example, an alternator may be coupled to the aforementioned drive shaft where the alternator includes at least one stator winding electrically coupled to a control circuit to selectively short the at least one stator winding to electromagnetically brake the alternator and thereby selectively brake rotation of the modulator rotor to modulate the pressure pulses in the mud.

In the example of FIG. 2, an uphole control and/or data acquisition system 262 may include circuitry to sense pressure pulses generated by telemetry equipment 252 and, for example, communicate sensed pressure pulses or information derived therefrom for process, control, etc.

The assembly 250 of the illustrated example includes a logging-while-drilling (LWD) module 254, a measurement-while-drilling (MWD) module 256, an optional module 258, a rotary-steerable system (RSS) and/or motor 260, and the drill bit 226. Such components or modules may be referred to as tools where a drillstring can include a plurality of tools.

As to a RSS, it involves technology utilized for directional drilling. Directional drilling involves drilling into the Earth to form a deviated bore such that the trajectory of the bore is not vertical; rather, the trajectory deviates from vertical along one or more portions of the bore. As an example, consider a target that is located at a lateral distance from a surface location where a rig may be stationed. In such an example, drilling can commence with a vertical portion and then deviate from vertical such that the bore is aimed at the target and, eventually, reaches the target. Directional drilling may be implemented where a target may be inaccessible from a vertical location at the surface of the Earth, where material exists in the Earth that may impede drilling or otherwise be detrimental (e.g., consider a salt dome, etc.), where a formation is laterally extensive (e.g., consider a relatively thin yet laterally extensive reservoir), where multiple bores are to be drilled from a single surface bore, where a relief well is desired, etc.

One approach to directional drilling involves a mud motor; however, a mud motor can present some challenges depending on factors such as rate of penetration (ROP), transferring weight to a bit (e.g., weight on bit, WOB) due to friction, etc. A mud motor can be a positive displacement motor (PDM) that operates to drive a bit (e.g., during directional drilling, etc.). A PDM operates as drilling fluid is pumped through it where the PDM converts hydraulic power of the drilling fluid into mechanical power to cause the bit to rotate.

As an example, a PDM may operate in a combined rotating mode where surface equipment is utilized to rotate a bit of a drillstring (e.g., a rotary table, a top drive, etc.) by rotating the entire drillstring and where drilling fluid is utilized to rotate the bit of the drillstring. In such an example, a surface RPM (SRPM or surface_RPM) may be determined by use of the surface equipment and a downhole RPM of the mud motor may be determined using various factors related to flow of drilling fluid, mud motor type, etc. As an example, in the combined rotating mode, bit RPM can be determined or estimated as a sum of the SRPM and the mud motor RPM, assuming the SRPM and the mud motor RPM are in the same direction.

As an example, a PDM mud motor can operate in a so-called sliding mode, when the drillstring is not rotated from the surface. In such an example, a bit RPM can be determined or estimated based on the RPM of the mud motor.

A RSS can drill directionally where there is continuous rotation from surface equipment, which can alleviate the sliding of a steerable motor (e.g., a PDM). A RSS may be deployed when drilling directionally (e.g., deviated, horizontal, or extended-reach wells). A RSS can aim to minimize interaction with a borehole wall, which can help to preserve borehole quality. A RSS can aim to exert a relatively consistent side force akin to stabilizers that rotate with the drillstring or orient the bit in the desired direction while continuously rotating at the same number of rotations per minute as the drillstring.

The LWD module 254 may be housed in a suitable type of drill collar and can contain one or a plurality of selected types of logging tools. It will also be understood that more than one LWD and/or MWD module can be employed, for example, as represented at by the module 256 of the drillstring assembly 250. Where the position of an LWD module is mentioned, as an example, it may refer to a module at the position of the LWD module 254, the module 256, etc. An LWD module can include capabilities for measuring, processing, and storing information, as well as for communicating with the surface equipment. In the illustrated example, the LWD module 254 may include a seismic measuring device.

The MWD module 256 may be housed in a suitable type of drill collar and can contain one or more devices for measuring characteristics of the drillstring 225 and the drill bit 226. As an example, the MWD tool 254 may include equipment for generating electrical power, for example, to power various components of the drillstring 225. As an example, the MWD tool 254 may include the telemetry equipment 252, for example, where the turbine impeller can generate power by flow of the mud; it being understood that other power and/or battery systems may be employed for purposes of powering various components. As an example, the MWD module 256 may include one or more of the following types of measuring devices: a weight-on-bit measuring device, a torque measuring device, a vibration measuring device, a shock measuring device, a stick slip measuring device, a direction measuring device, and an inclination measuring device.

FIG. 2 also shows some examples of types of holes that may be drilled. For example, consider a slant hole 272, an S-shaped hole 274, a deep inclined hole 276 and a horizontal hole 278.

As an example, a drillstring can include an azimuthal density neutron (ADN) tool for measuring density and porosity; a MWD tool for measuring inclination, azimuth and shocks; a compensated dual resistivity (CDR) tool for measuring resistivity and gamma ray related phenomena; one or more variable gauge stabilizers; one or more bend joints; and a geosteering tool, which may include a motor and optionally equipment for measuring and/or responding to one or more of inclination, resistivity and gamma ray related phenomena.

As an example, geosteering can include intentional directional control of a wellbore based on results of downhole geological logging measurements in a manner that aims to keep a directional wellbore within a desired region, zone (e.g., a pay zone), etc. As an example, geosteering may include directing a wellbore to keep the wellbore in a particular section of a reservoir, for example, to minimize gas and/or water breakthrough and, for example, to maximize economic production from a well that includes the wellbore.

Referring again to FIG. 2, the wellsite system 200 can include one or more sensors 264 that are operatively coupled to the control and/or data acquisition system 262. As an example, a sensor or sensors may be at surface locations. As an example, a sensor or sensors may be at downhole locations. As an example, a sensor or sensors may be at one or more remote locations that are not within a distance of the order of about one hundred meters from the wellsite system 200. As an example, a sensor or sensor may be at an offset wellsite where the wellsite system 200 and the offset wellsite are in a common field (e.g., oil and/or gas field).

As an example, one or more of the sensors 264 can be provided for tracking pipe, tracking movement of at least a portion of a drillstring, etc.

As an example, the system 200 can include one or more sensors 266 that can sense and/or transmit signals to a fluid conduit such as a drilling fluid conduit (e.g., a drilling mud conduit). For example, in the system 200, the one or more sensors 266 can be operatively coupled to portions of the standpipe 208 through which mud flows. As an example, a downhole tool can generate pulses that can travel through the mud and be sensed by one or more of the one or more sensors 266. In such an example, the downhole tool can include associated circuitry such as, for example, encoding circuitry that can encode signals, for example, to reduce demands as to transmission. As an example, circuitry at the surface may include decoding circuitry to decode encoded information transmitted at least in part via mud-pulse telemetry. As an example, circuitry at the surface may include encoder circuitry and/or decoder circuitry and circuitry downhole may include encoder circuitry and/or decoder circuitry. As an example, the system 200 can include a transmitter that can generate signals that can be transmitted downhole via mud (e.g., drilling fluid) as a transmission medium.

As an example, one or more portions of a drillstring may become stuck. The term stuck can refer to one or more of varying degrees of inability to move or remove a drillstring from a bore. As an example, in a stuck condition, it might be possible to rotate pipe or lower it back into a bore or, for example, in a stuck condition, there may be an inability to move the drillstring axially in the bore, though some amount of rotation may be possible. As an example, in a stuck condition, there may be an inability to move at least a portion of the drillstring axially and rotationally.

As to the term "stuck pipe", this can refer to a portion of a drillstring that cannot be rotated or moved axially. As an example, a condition referred to as "differential sticking" can be a condition whereby the drillstring cannot be moved (e.g., rotated or reciprocated) along the axis of the bore. Differential sticking may occur when high-contact forces caused by low reservoir pressures, high wellbore pressures, or both, are exerted over a sufficiently large area of the drillstring. Differential sticking can have time and financial cost.

As an example, a sticking force can be a product of the differential pressure between the wellbore and the reservoir and the area that the differential pressure is acting upon. This means that a relatively low differential pressure (delta p) applied over a large working area can be just as effective in sticking pipe as can a high differential pressure applied over a small area.

As an example, a condition referred to as "mechanical sticking" can be a condition where limiting or prevention of motion of the drillstring by a mechanism other than differential pressure sticking occurs. Mechanical sticking can be caused, for example, by one or more of junk in the hole, wellbore geometry anomalies, cement, keyseats or a buildup of cuttings in the annulus.

Figure 3:
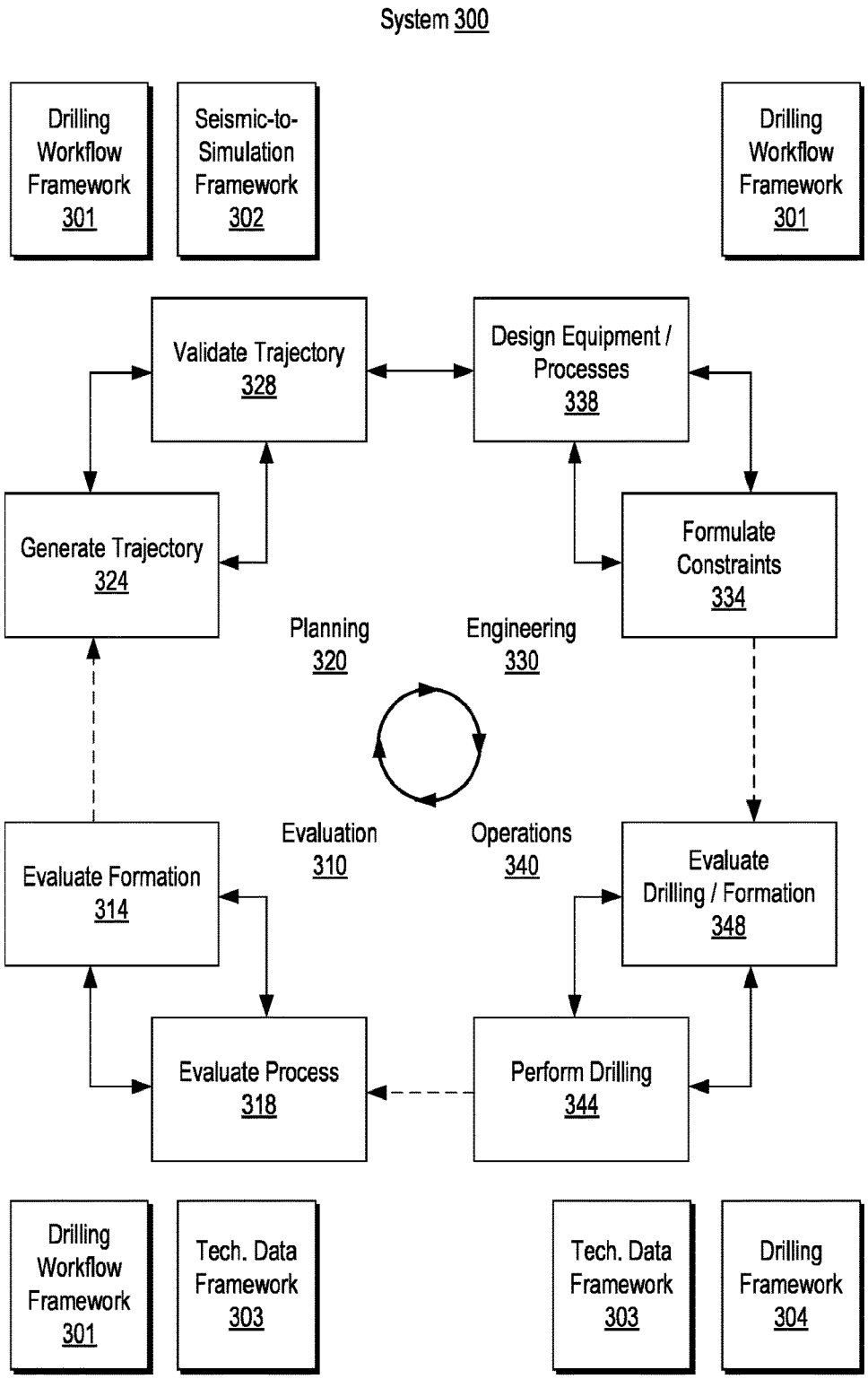
FIG. 3 illustrates an example of a system.

FIG. 3 shows an example of a system 300 that includes various equipment for evaluation 310, planning 320, engineering 330 and operations 340. For example, a drilling workflow framework 301, a seismic-to-simulation framework 302, a technical data framework 303 and a drilling framework 304 may be implemented to perform one or more processes such as a evaluating a formation 314, evaluating a process 318, generating a trajectory 324, validating a trajectory 328, formulating constraints 334, designing equipment and/or processes based at least in part on constraints 338, performing drilling 344 and evaluating drilling and/or formation 348.

In the example of FIG. 3, the seismic-to-simulation framework 302 can be, for example, the PETREL framework (Schlumberger, Houston, Texas) and the technical data framework 303 can be, for example, the TECHLOG framework (Schlumberger, Houston, Texas).

As an example, a framework can include entities that may include earth entities, geological objects or other objects such as wells, surfaces, reservoirs, etc. Entities can include virtual representations of actual physical entities that are reconstructed for purposes of one or more of evaluation, planning, engineering, operations, etc.

As an example, a framework may be implemented within or in a manner operatively coupled to the DELFI cognitive exploration and production (E&P) environment (Schlumberger, Houston, Texas), which is a secure, cognitive, cloud-based collaborative environment that integrates data and workflows with digital technologies, such as artificial intelligence and machine learning. As an example, such an environment can provide for operations that involve one or more frameworks.

As an example, various aspects of a workflow may be completed automatically, may be partially automated, or may be completed manually, as by a human user interfacing with a software application that executes using hardware (e.g., local and/or remote). As an example, a workflow may be cyclic, and may include, as an example, four stages such as, for example, an evaluation stage (see, e.g., the evaluation equipment 310), a planning stage (see, e.g., the planning equipment 320), an engineering stage (see, e.g., the engineering equipment 330) and an execution stage (see, e.g., the operations equipment 340). As an example, a workflow may commence at one or more stages, which may progress to one or more other stages (e.g., in a serial manner, in a parallel manner, in a cyclical manner, etc.).

As an example, a workflow can include considering a well trajectory, including an accepted well engineering plan, and a formation evaluation. Such a workflow may then pass control to a drilling service provider, which may implement the well engineering plan, establishing safe and efficient drilling, maintaining well integrity, and reporting progress as well as operating parameters (see, e.g., the blocks 344 and 348). As an example, operating parameters, formation encountered, data collected while drilling (e.g., using logging-while-drilling or measuring-while-drilling technology), may be returned to a geological service provider for evaluation. As an example, the geological service provider may then re-evaluate the well trajectory, or one or more other aspects of the well engineering plan, and may, in some cases, and potentially within predetermined constraints, adjust the well engineering plan according to the real-life drilling parameters (e.g., based on acquired data in the field, etc.).

Whether the well is entirely drilled, or a section thereof is completed, depending on the specific embodiment, a workflow may proceed to a post review (see, e.g., the evaluation block 318). As an example, a post review may include reviewing drilling performance. As an example, a post review may further include reporting the drilling performance (e.g., to one or more relevant engineering, geological, or G&G service providers).

Various activities of a workflow may be performed consecutively and/or may be performed out of order (e.g., based partially on information from templates, nearby wells, etc. to fill in any gaps in information that is to be provided by another service provider). As an example, undertaking one activity may affect the results or basis for another activity, and thus may, either manually or automatically, call for a variation in one or more workflow activities, work products, etc. As an example, a server may allow for storing information on a central database accessible to various service providers where variations may be sought by communication with an appropriate service provider, may be made automatically, or may otherwise appear as suggestions to the relevant service provider. Such an approach may be considered to be a holistic approach to a well workflow, in comparison to a sequential, piecemeal approach.

As an example, various actions of a workflow may be repeated multiple times during drilling of a wellbore. For example, in one or more automated systems, feedback from a drilling service provider may be provided at or near real-time, and the data acquired during drilling may be fed to one or more other service providers, which may adjust its piece of the workflow accordingly. As there may be dependencies in other areas of the workflow, such adjustments may permeate through the workflow, e.g., in an automated fashion. In some embodiments, a cyclic process may additionally or instead proceed after a certain drilling goal is reached, such as the completion of a section of the wellbore, and/or after the drilling of the entire wellbore, or on a per-day, week, month, etc. basis.

Well planning can include determining a path of a well (e.g., a trajectory) that can extend to a reservoir, for example, to economically produce fluids such as hydrocarbons therefrom. Well planning can include selecting a drilling and/or completion assembly which may be used to implement a well plan. As an example, various constraints can be imposed as part of well planning that can impact design of a well. As an example, such constraints may be imposed based at least in part on information as to known geology of a subterranean domain, presence of one or more other wells (e.g., actual and/or planned, etc.) in an area (e.g., consider collision avoidance), etc. As an example, one or more constraints may be imposed based at least in part on characteristics of one or more tools, components, etc. As an example, one or more constraints may be based at least in part on factors associated with drilling time and/or risk tolerance.

As an example, a system can allow for a reduction in waste, for example, as may be defined according to LEAN. In the context of LEAN, consider one or more of the following types of waste: transport (e.g., moving items unnecessarily, whether physical or data); inventory (e.g., components, whether physical or informational, as work in process, and finished product not being processed); motion (e.g., people or equipment moving or walking unnecessarily to perform desired processing); waiting (e.g., waiting for information, interruptions of production during shift change, etc.); overproduction (e.g., production of material, information, equipment, etc. ahead of demand); over processing (e.g., resulting from poor tool or product design creating activity); and defects (e.g., effort involved in inspecting for and fixing defects whether in a plan, data, equipment, etc.). As an example, a system that allows for actions (e.g., methods, workflows, etc.) to be performed in a collaborative manner can help to reduce one or more types of waste.

Figure 4:
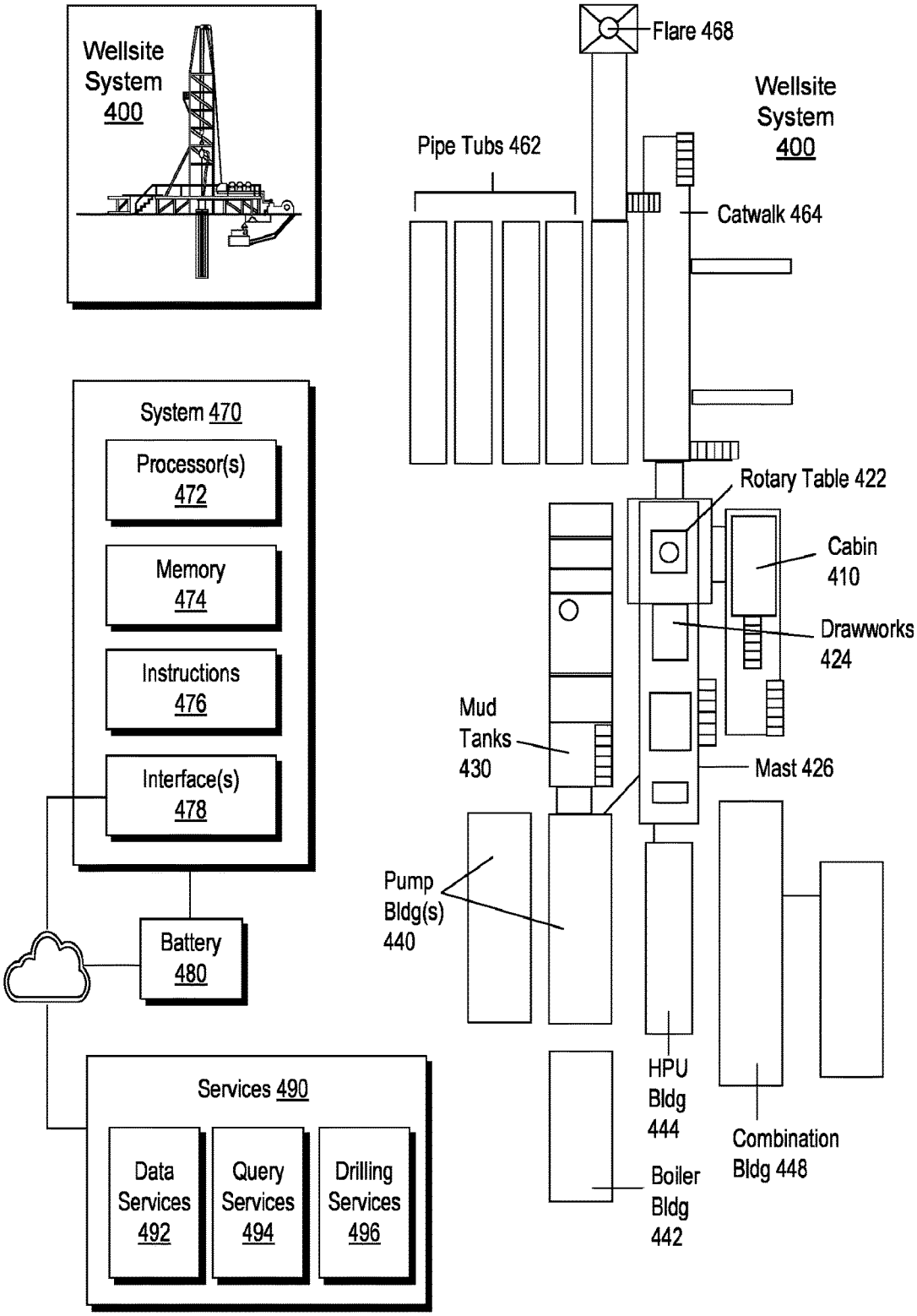
FIG. 4 illustrates an example of a wellsite system and an example of a computing system.

FIG. 4 shows an example of a wellsite system 400 (e.g., a rigsite system), specifically, FIG. 4 shows the wellsite system 400 in an approximate side view and an approximate plan view along with a block diagram of a system 470.

In the example of FIG. 4, the wellsite system 400 can include a cabin 410, a rotary table 422, drawworks 424, a mast 426 (e.g., optionally carrying a top drive, etc.), mud tanks 430 (e.g., with one or more pumps, one or more shakers, etc.), one or more pump buildings 440, a boiler building 442, an HPU building 444 (e.g., with a rig fuel tank, etc.), a combination building 448 (e.g., with one or more generators, etc.), pipe tubs 462, a catwalk 464, a flare 468, etc. Such equipment can include one or more associated functions and/or one or more associated operational risks, which may be risks as to time, resources, and/or humans.

As shown in the example of FIG. 4, the wellsite system 400 can include a system 470 that includes one or more processors 472, memory 474 operatively coupled to at least one of the one or more processors 472, instructions 476 that can be, for example, stored in the memory 474, and one or more interfaces 478. As an example, the system 470 can include one or more processor-readable media that include processor-executable instructions executable by at least one of the one or more processors 472 to cause the system 470 to control one or more aspects of the wellsite system 400. In such an example, the memory 474 can be or include the one or more processor-readable media where the processor-executable instructions can be or include instructions. As an example, a processor-readable medium can be a computer-readable storage medium that is not a signal and that is not a carrier wave.

FIG. 4 also shows a battery 480 that may be operatively coupled to the system 470, for example, to power the system 470. As an example, the battery 480 may be a back-up battery that operates when another power supply is unavailable for powering the system 470. As an example, the battery 480 may be operatively coupled to a network, which may be a cloud network. As an example, the battery 480 can include smart battery circuitry and may be operatively coupled to one or more pieces of equipment via a SMBus or other type of bus.

In the example of FIG. 4, services 490 are shown as being available, for example, via a cloud platform. Such services can include data services 492, query services 494 and drilling services 496. As an example, the services 490 may be part of a system such as the system 300 of FIG. 3.

As an example, a system can include a framework that can acquire data such as, for example, real time data associated with one or more operations such as, for example, a drilling operation or drilling operations. As an example, consider the PERFORM toolkit framework (Schlumberger Limited, Houston, Texas).

As an example, a service can be or include one or more of OPTIDRILL, OPTILOG and/or other services marketed by Schlumberger Limited, Houston, Texas.

The OPTIDRILL technology can help to manage downhole conditions and BHA dynamics as a real time drilling intelligence service. The service can incorporate a rigsite display (e.g., a wellsite display) of integrated downhole and surface data that provides actionable information to mitigate risk and increase efficiency. As an example, such data may be stored, for example, to a database system (e.g., consider a database system associated with the STUDIO framework).

The OPTILOG technology can help to evaluate drilling system performance with single- or multiple-location measurements of drilling dynamics and internal temperature from a recorder. As an example, post-run data can be analyzed to provide input for future well planning.

As an example, information from a drill bit database may be accessed and utilized. For example, consider information from Smith Bits (Schlumberger Limited, Houston, Texas), which may include information from various operations (e.g., drilling operations) as associated with various drill bits, drilling conditions, formation types, etc.

As an example, one or more QTRAC services (Schlumberger Limited, Houston Texas) may be provided for one or more wellsite operations. In such an example, data may be acquired and stored where such data can include time series data that may be received and analyzed, etc.

As an example, one or more M-I SWACO services (M-I L.L.C., Houston, Texas) may be provided for one or more wellsite operations. For example, consider services for value-added completion and reservoir drill-in fluids, additives, cleanup tools, and engineering. In such an example, data may be acquired and stored where such data can include time series data that may be received and analyzed, etc.

As an example, one or more ONE-TRAX services (e.g., via the ONE-TRAX software platform, M-I L.L.C., Houston, Texas) may be provided for one or more wellsite operations. In such an example, data may be acquired and stored where such data can include time series data that may be received and analyzed, etc.

As an example, various operations can be defined with respect to WITS or WITSML, which are acronyms for well-site information transfer specification or standard (WITS) and markup language (WITSML). WITS/WITSML specify how a drilling rig or offshore platform drilling rig can communicate data. For example, as to slips, which are an assembly that can be used to grip a drillstring in a relatively non-damaging manner and suspend the drillstring in a rotary table, WITS/WITSML define operations such as "bottom to slips" time as a time interval between coming off bottom and setting slips, for a current connection; "in slips" as a time interval between setting the slips and then releasing them, for a current connection; and "slips to bottom" as a time interval between releasing the slips and returning to bottom (e.g., setting weight on the bit), for a current connection.

Well construction can occur according to various procedures, which can be in various forms. As an example, a procedure can be specified digitally and may be, for example, a digital plan such as a digital well plan. A digital well plan can be an engineering plan for constructing a wellbore. As an example, procedures can include information such as well geometries, casing programs, mud considerations, well control concerns, initial bit selections, offset well information, pore pressure estimations, economics and special procedures that may be utilized during the course of well construction, production, etc. While a drilling procedure can be carefully developed and specified, various conditions can occur that call for adjustment to a drilling procedure.

Figure 5:
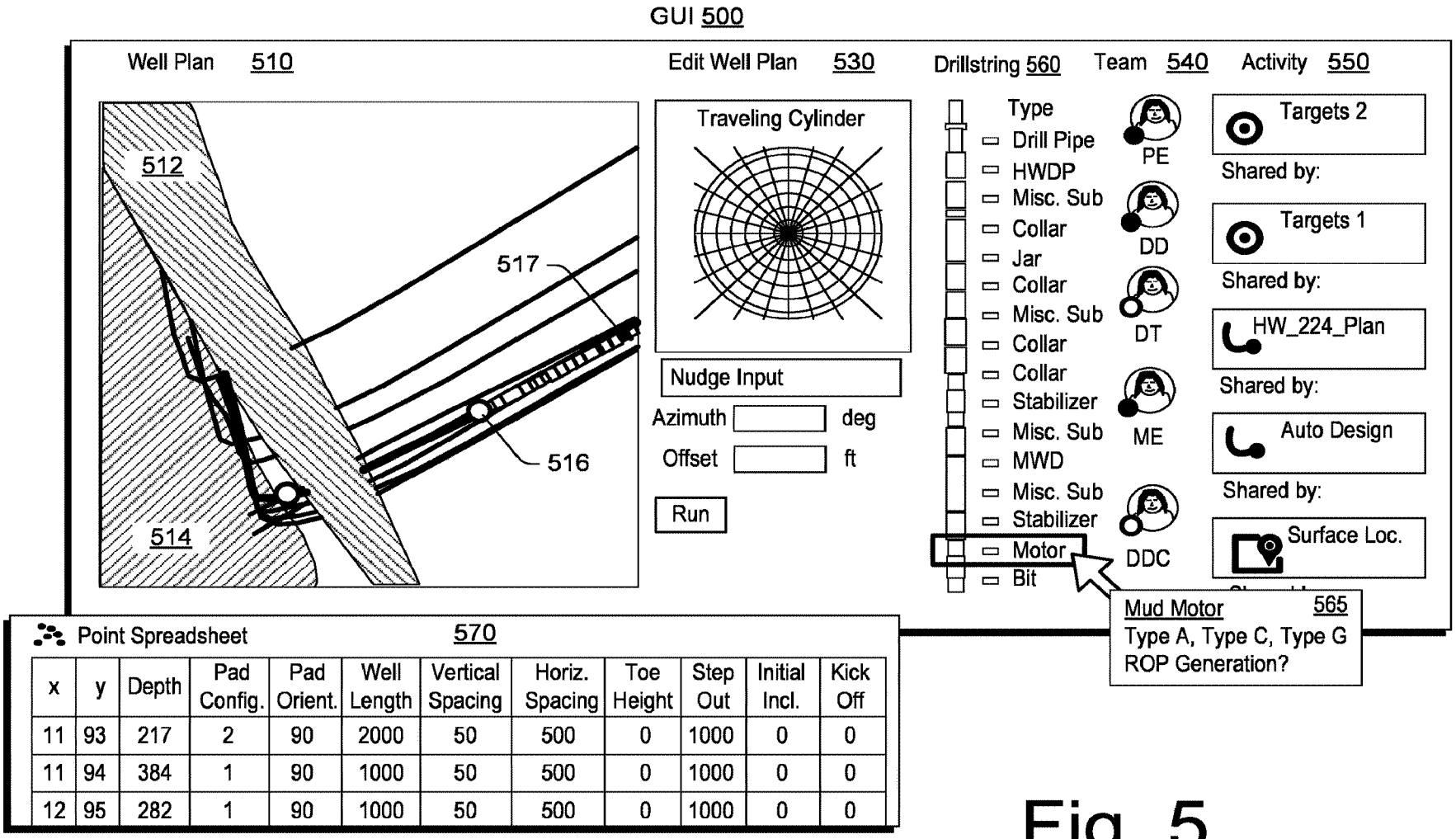
FIG. 5 illustrates an example of a graphical user interface.

FIG. 5 shows an example of a graphical user interface (GUI) 500 that includes information associated with a well plan. Specifically, the GUI 500 includes a panel 510 where surfaces representations 512 and 514 are rendered along with well trajectories where a location 516 can represent a position of a drillstring 517 along a well trajectory. The GUI 500 may include one or more editing features such as an edit well plan set of features 530. The GUI 500 may include information as to individuals of a team 540 that are involved, have been involved and/or are to be involved with one or more operations. The GUI 500 may include information as to one or more activities 550.

As shown in the example of FIG. 5, the GUI 500 can include a graphical control of a drillstring 560 where, for example, various portions of the drillstring 560 may be selected to expose one or more associated parameters (e.g., type of equipment, equipment specifications, operational history, etc.). In the example of FIG. 5, the drillstring graphical control 560 includes components such as drill pipe, heavy weight drill pipe (HWDP), subs, collars, jars, stabilizers, motor(s) and a bit. A drillstring can be a combination of drill pipe, a bottom hole assembly (BHA) and one or more other tools, which can include one or more tools that can help a drill bit turn and drill into material (e.g., a formation).

As an example, a workflow can include utilizing the graphical control of the drillstring 560 to select and/or expose information associated with a component or components such as, for example, a bit and/or a mud motor. As an example, in response to selection of a bit and/or a mud motor (e.g., consider a bit and mud motor combination), a computational framework, which may be utilized, for example, to operating drilling equipment in a particular mode. In the example of FIG. 5, a graphical control 565 is shown that can be rendered responsive to interaction with the graphical control of the drillstring 560, for example, to select a type of component, etc.

As an example, the GUI 500 can include a graphical control for an auto driller, which may be rendered to a display for actuating, monitoring, controlling, etc., an auto driller (e.g., an automated drilling system, etc.). In such an example, a menu item can provide for interaction with a going on-bottom controller (see, e.g., the system 1000 of FIG. 10). As an example, the GUI 500 can include one or more graphical controls for interaction with a system such as the system 470 of FIG. 4.

FIG. 5 also shows an example of a table 570 as a point spreadsheet that specifies information for a plurality of wells. As shown in the example table 570, coordinates such as "x" and "y" and "depth" can be specified for various features of the wells, which can include pad parameters, spacings, toe heights, step outs, initial inclinations, kick offs, etc.

Figure 6:
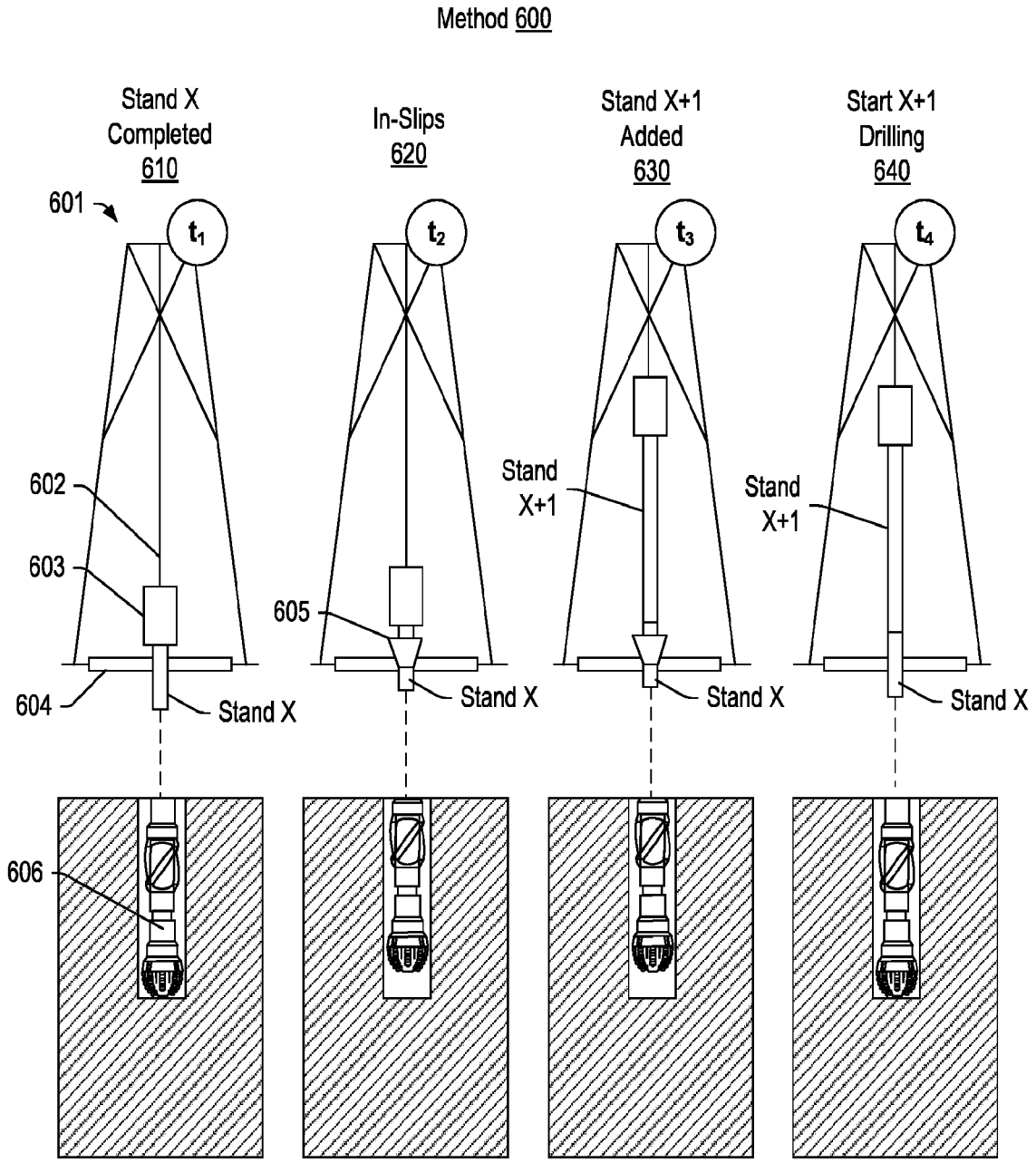
FIG. 6 illustrates an example of a method.

FIG. 6 shows an example of a method 600 that utilizes drilling equipment to perform drilling operations. As shown, the drilling equipment includes a rig 601, a lift system 602, a block 603, a platform 604, slips 605 and a bottom hole assembly (BHA) 606. As shown, the rig 601 supports the lift system 602, which provides for movement of the block 603 above the platform 604 where the slips 605 may be utilized to support a drillstring that includes the bottom hole assembly 606, which is shown as including a bit to drill into a formation to form a borehole.

As to the drilling operations, they include a first operation 610 that completes a stand (Stand X) of the drillstring; a second operation 620 that pulls the drillstring off the bottom of the borehole by moving the block 603 upwardly and that supports the drillstring in the platform 604 using the slips 605; a third operation 630 that adds a stand (Stand X+1) to the drillstring; and a fourth operation 640 that removes the slips 605 and that lowers the drillstring to the bottom of the borehole by moving the block 603 downwardly. Various details of examples of equipment and examples of operations are also explained with respect to FIGS. 1, 2, 3, 4 and 5.

As an example, drilling operations may utilize one or more types of equipment to drill, which can provide for various modes of drilling. As a borehole is deepened by drilling, as explained, stands can be added to a drillstring. A stand can be one or more sections of pipe; noting that a pipe-by-pipe or hybrid stand and pipe approach may be utilized.

In the example of FIG. 6, the operations 610, 620, 630 and 640 may take a period of time that may be of the order of minutes. For example, consider the amount of time it takes to position and connect a stand to another stand of a drillstring. A stand may be approximately 30 meters in length (e.g., approximately 90 ft with three 30 ft long pipes connected together) where precautions are taken to avoid detrimental contacting of the stand (metal or metal alloy) with other equipment or humans. During the period of time, one or more types of calculations, computations, communications, etc., may occur. For example, a driller may perform a depth of hole calculation based on a measured length of a stand, etc. As an example, a driller may analyze survey data as acquired by one or more downhole tools of a drillstring. Such survey data may help a driller to determine whether or not a planned or otherwise desired trajectory is being followed, which may help to inform the driller as to how drilling is to occur for an increase in borehole depth corresponding approximately to the length of the added stand.

As an example, where a top drive is utilized (e.g., consider the block 603 as including a top drive), as the top drive approaches the platform 604, rotation and circulation can be stopped and the drillstring lifted a distance off the bottom of the borehole. As the top drive is to be coupled to another stand, it is to be disconnected, which means that the drillstring is to be supported, which can be accomplished through use of the slips 605. The slips 605 can be set on a portion of the last stand (e.g., a pipe) to support the weight of the drillstring such that the top drive can be disconnected from the drillstring by operator(s), for example, using a top drive pipehandler. Once disconnected, the driller can then raise the top drive (e.g., the block 603) to an appropriate level such as a fingerboard level, where another stand of pipe (e.g., approximately 30 m) can be delivered to a set of drill pipe elevators hanging from the top drive. The stand (e.g., Stand X+1) can be raised and stabbed into the drillstring. The top drive can then be lowered until its drive stem engages an upper connection of the stand (e.g., Stand X+1). The top drive motor can be engaged to rotate the drive stem such that upper and lower connections of the stand are made up relatively simultaneously. In such an example, a backup tong may be used at the platform 604 (e.g., drill floor) to prevent rotation of the drillstring as the connections are being made. After the connections are properly made up, the slips 605 can be released (e.g., out-of-slips). Circulation of drilling fluid (e.g., mud) can commence (e.g., resume) and, once the bit of the bottom hole assembly 606 contacts the bottom of the borehole, the top drive can be utilized for drilling to deepen the borehole. The entire process, from the time the slips are set on the drillstring (e.g., in-slips), a new stand is added, the connections are made up, and the slips are released (e.g., out-of-slips), allowing drilling to resume, can take on the order of tens of seconds to minutes, generally less than 10 minutes where operations are normal and as expected.

As to the aforementioned top drive approach, the process of adding a new stand of pipe to the drillstring, and drilling down toward the platform (e.g., the floor), can involve fewer actions and demand less involvement from a drill crew when compared to kelly drilling (e.g., rotary table drilling). Drillers and rig crews can become relatively proficient in drilling with top drives. Built-in features such as thread compensation, remote-controlled valves to stop the flow of drilling fluids, and mechanisms to tilt the elevators and links to the derrickman or floor crew can add to speed, convenience and safety associated with top drive drilling.

As an example, a top drive can be utilized when drilling with single joints (e.g., 10 m or 30 ft lengths) of pipe, although greater benefit may be achieved by drilling with triples (e.g., stands of pipe where a stand can be approximately 30 m long). As explained, with the drill pipe being supported and rotated from the top, an entire stand of drill pipe can be drilled down at one time. Such an approach can extend the time the bit is on bottom and can help to produce a cleaner borehole. Compared to kelly drilling, where a connection is made after drilling down a single joint of pipe, top drive drilling can result in faster drilling by reducing demand for two out of three connections.

During drilling, a length along a borehole can be tracked manually and recorded as measured depth (MD). Measured depth can be the length of a borehole, for example, as if determined by a measuring stick. For deviated wells, measured depth differs from the true vertical depth (TVD) (see, e.g., the example boreholes 272, 274, 276 and 278 of FIG. 2). As a borehole is not practically physically measurable from end to end, one approach to determining measured depth is by measuring lengths of individual joints of drillpipe, drill collars and other drillstring elements using a physical tape measure where such individual measurements can be recorded (e.g., as a ledger, a spreadsheet, etc.) and summed to arrive at a measured depth value. In a manual approach, a pipe or pipes connected as a stand can be measured while in a derrick or while laying on a pipe rack where the pipe or pipes are in a substantially untensioned, unstressed state when compared to pipe condition during drilling and/or in a borehole. When pipes are screwed together and put into a borehole, they can stretch under their own weight and that of a bottom hole assembly, etc. Such length-related phenomena are generally not taken into account when manually reporting the measured depth based on the tape measure approach. In various instances, the actual borehole can be slightly longer than the reported measured depth. In various instances, a driller may manually adjust a tally or tallies as to bit depth and hole depth; however, in some instances one may be adjusted without the other being adjusted. As explained, manual approaches to lengths can be prone to inaccuracies (e.g., human behavior, human error, etc.).

As an example, a method can include automated drilling where data as to length or lengths can be acquired automatically and utilized to guide such automated drilling. In such an example, slips status and block position (BPOS) may be utilized, which can be acquired using one or more of various types of sensors, detectors, etc. For example, whether slips are operated manually, semi-automatically or automatically, a detector can determine slips status such as, for example, in-slips or out-of-slips. As to block position, it can be determined using one or more approaches, which can utilize cameras (e.g., machine vision), position sensors, a combination of sensors, etc. For example, consider a camera or cameras that are positioned with a field of view (FOV) that can determine block position. As another example, consider an accelerometer based approach that can determine velocity and time, where velocity and time can be utilized to determine a distance. As an example, an approach to block position can utilize a combination of techniques, which can include, for example, one or more cameras and one or more sensors, which can include one or more block mounted sensors.

As an example, a method can include receiving an initial on-bottom signal, which may be a time signal, a state signal, etc. Such a signal may be acquired automatically, semi-automatically or manually. As an example, rig equipment can include a button that can be actuated (e.g., pressed, clicked, etc.) to indicate an initial on-bottom condition, which may be utilized with respect to one or more determinations as to slips status and/or block position, which, in turn, may be utilized by an automated system that can perform at least some drilling operations. As another example, an electronic unit can receive one or more channels of data from one or more sensors, detectors, etc., at a rigsite where the electronic unit can process the data to determine an initial on-bottom state (see, e.g., the system 470 of FIG. 4, etc.). As an example, a combination of approaches may be utilized, for example, a manual push button and an automated, algorithm-based approach. In such an example, a comparison may be made between values from the combination of approaches, optionally selecting one value over the other, averaging, etc. As to an initial on-bottom state, it can correspond to a state drilling is complete for a pipe or a stand of a drillstring where a bit of the drillstring is on-bottom (e.g., in an on-bottom state) and where a subsequent operation may be performed with respect to drilling for another pipe or another stand. As an example, an on-bottom state may be after a type of trip that trips a drillstring into a borehole, deeper into a borehole (e.g., run in hole, RIH), where a bit of the drillstring reaches the bottom of the borehole and where a subsequent operation is to follow, which can include adding a pipe, a stand, etc.

As an example, after receipt of an initial on-bottom signal indicative of an on-bottom state, a method can include utilizing data indicative of slips status and block position for purposes of controlling a subsequent drilling operation. For example, an auto driller (e.g., a computerized drilling operations controller, etc.) may be utilized to drill to lengthen a borehole in a time period or state that is not between in-slips and out-of-slips. However, the auto driller can, for example, be active to acquire data during that time period or state that is between in-slips and out-of-slips where such acquired data can be utilized to instruct how the auto driller operates in a post-out-of-slips time period or state. For example, such an auto driller can utilize such acquired data to go on-bottom where going on-bottom is part of a process that includes, after going on-bottom, drilling to further lengthen the borehole. Such an approach can help to optimize operation of the auto driller, optionally without reliance on manually recorded lengths (e.g., measured depths), which may be for bit depth or borehole depth (e.g., as measured depths).

As an example, a driller may track bit depth and borehole depth manually, for one or more purposes, while an auto driller utilizes an automated approach for purposes of going on-bottom, for example, to help assure that the auto driller can return a bit to the same point in a borehole (e.g., a bottom point) after an in-slips to out-of-slips operation, which may be for adding pipe to a drillstring to perform further drilling that lengthens the borehole. As an example, data acquired via an auto driller for such a purpose may optionally be utilized by a driller, for example, to assess manually measured bit depth, manually measured borehole depth (HD), etc.

Block position data can be a relatively reliable type of data as block position can be constrained, for example, due to equipment and/or safety concerns. For example, a lower position limit as to block position can be set with respect to a rig floor while an upper position limit as to block position can be set with respect to equipment at or near the top of a rig. As explained, slips status can be utilized in combination with block position for purposes of auto driller control, which, for example, can be utilized in a manner that is isolated from bit depth and hole depth (HD) as determined manually.

As to an in-slips status, a method can include determining how much pipe length has been added to a drillstring via utilization of block position data. In such a method, the pipe length can be utilized for determining how to go back on bottom, which can include positioning a bit of the drillstring back on bottom (e.g., an on-bottom state). As to the question of "how", consider an auto driller that can control one or more of various parameters such as, for example, velocity, acceleration, deceleration, rotation, etc. For example, as the drill bit approaches bottom, the drill bit can be rotating and the velocity of the drill bit can be controlled to approximate a desired rate of penetration (ROP) for drilling into a formation to lengthen the borehole. In such an example, the ROP may be a ROP determined for a prior length of pipe, which can be an actual ROP; noting that as material in a formation can differ (e.g., lithology, composition, etc.), an ROP may be utilized that differs from that of a prior length of pipe.

As an example, a method can include determining when a drill bit has returned to an on-bottom state, as may be achieved using an auto driller. In such an example, an actual on-bottom state length can be compared to an estimated on-bottom state length where the estimated on-bottom state length is determined using data from slips status and block position during an immediately prior in-slips to out-of-slips period (e.g., per a prior on-bottom signal after completion of drilling for a length of pipe).

Referring again to the method 600, as to the operation 610, the completion of Stand X can be due to the position of the block 603 reaching a lower position limit, for example, a lower position limit that is a distance from the rig floor 604. At the completion of Stand X, the driller can then control the block 603 such that its position changes by rising toward the top of the rig 601, which pulls the drill bit of the bottom hole assembly 606 of the drillstring off bottom. Such a point, commencement of raising the block 603, can be detected as a transition point, for example, from a moving down or a stationary point to moving up. As explained, with the drill bit lifted off bottom, the method 600 can proceed to the operation 620, which is going into slips (e.g., in-slips state) through utilization of the slips 605. As explained, a method can include determining block position of a block for in-slips states and determining block position for going out-of-slips (e.g., out-of-slips states) where a difference between the two positions can approximate length of pipe added to the drillstring. Such an approach can be more robust for purposes of control of an auto driller when compared to reliance on manually measured and recorded length(s).

As an example, a method can include utilizing a block position-based pipe length in combination with a block position for a bit coming off bottom, where a block on-bottom position for the bit may be considered to be a reference position (e.g., zero), to return the bit to being on-bottom using a determined block position. Such an approach can be repeated for pipe lengths added to a drillstring without cumulative errors that may be present in manually tabulated bit depth and/or hole depth measurements. As an example, for a given null as a reference, a method can utilize two values to determine a third value where the third value is utilized to properly control going on-bottom. As an example, a completion block position for an added length of pipe may also be estimated.

As to pulling a drill bit of a drillstring off bottom, the drillstring may be considered to be of a relatively fixed length such that the distance pulled off bottom can be representative of a distance to return the drill bit to bottom after adding a length of pipe to the drillstring where the time for adding the length of pipe may be of the order of minutes (e.g., less than approximately 20 minutes, etc.).

As explained, a method can determine a block position that can be utilized by an auto driller to return a drill bit of a drillstring to bottom. Such a block position can be tracked and utilized to control equipment that positions the block (e.g., drawworks, etc.). As an example, an auto driller can be operatively coupled to one or more sensors, detectors, etc., and to drawworks for purposes of returning a drill bit of a drillstring coupled to the block to a bottom of a borehole. As an example, a method can include determining how far off bottom and when on bottom. In such an example, "bottom"

can be a relative bottom position that can be relative to an operation or operations that can be cyclical (e.g., pipe by pipe, stand by stand, etc.).

As an example, a method can include receiving two channels of data where one channel is for slips status and the other channel is for block position. Such a method can include determining a block position that corresponds to an on-bottom position for moving a drill bit of a drillstring on to the bottom of a borehole. As explained, such a method can be free of human tabulation.

As explained, various types of automated systems (e.g., auto drillers, etc.) may aim to help a drilling operation to achieve gains with noticeably faster rates of penetration. As an example, an automated system can provide automation in a slips-to-slips manner where, automation commences upon coming out-of-slips (e.g., to go on-bottom). Drilling operations of an automated system can be deemed "slips to slips". As explained drilling operations can include coming off bottom, working pipe, circulating, working out friction in a drillstring (e.g., once or twice, etc.), and then returning to a stick-up position.

As to going on-bottom, a block can move at a particular speed (velocity) to approach bottom and then reduce the speed (velocity) within a certain distance from bottom, for example, to achieve a suitable landing of the bit on bottom, which, as mentioned, may correspond to a rate of penetration (ROP). As to a first speed, consider being approximately 10 feet off bottom and using a speed of approximately X ft per hour (e.g., consider approximately 150 ft per hour or approximately 2.5 ft per minute such that it takes about 3.2 minutes to move 8 feet) until approximately 2 feet off bottom and transitioning to a second speed that is less than the first speed, which may be an approximate desired ROP (e.g., such that it takes more than about 0.8 minutes to land). In such an example, speeds (e.g., maximum speed, etc.) can be limited for one or more reasons (e.g., safety, equipment integrity, etc.). As explained, a speed, which may be a landing speed, can be controlled more accurately as to when it is implemented using an automated approach that includes using slips status and block position. As mentioned, a landing speed can be an expected ROP. Prior to implementing a landing speed, speed may be greater, which can help to optimize drilling (e.g., less non-productive time, NPT). As explained, a "soft" landing can allow for more optimal contact between a bit and rock, which, if performed in a rather consistent manner for drilling a section or more of a borehole, bit life may be preserved, formation damage reduced (e.g., borehole borewall damage, etc.), etc., which may help to optimize drilling, facilitate estimates of equipment usage, time for drilling, etc. As explained, drilling can be performed more consistently using an auto driller that uses slips status and block position for purposes of landing a bit.

As an example, an auto driller can operate in a manner that aims to improve driller trust. For example, where landing can be performed in a relative manner and consistently without undesirably jamming a drill bit into rock, the driller may gain trust in the auto driller. Further, as mentioned, an auto driller can provide data that can help a driller assess tabulations as to one or more of bit depth and hole depth.

Figure 7:
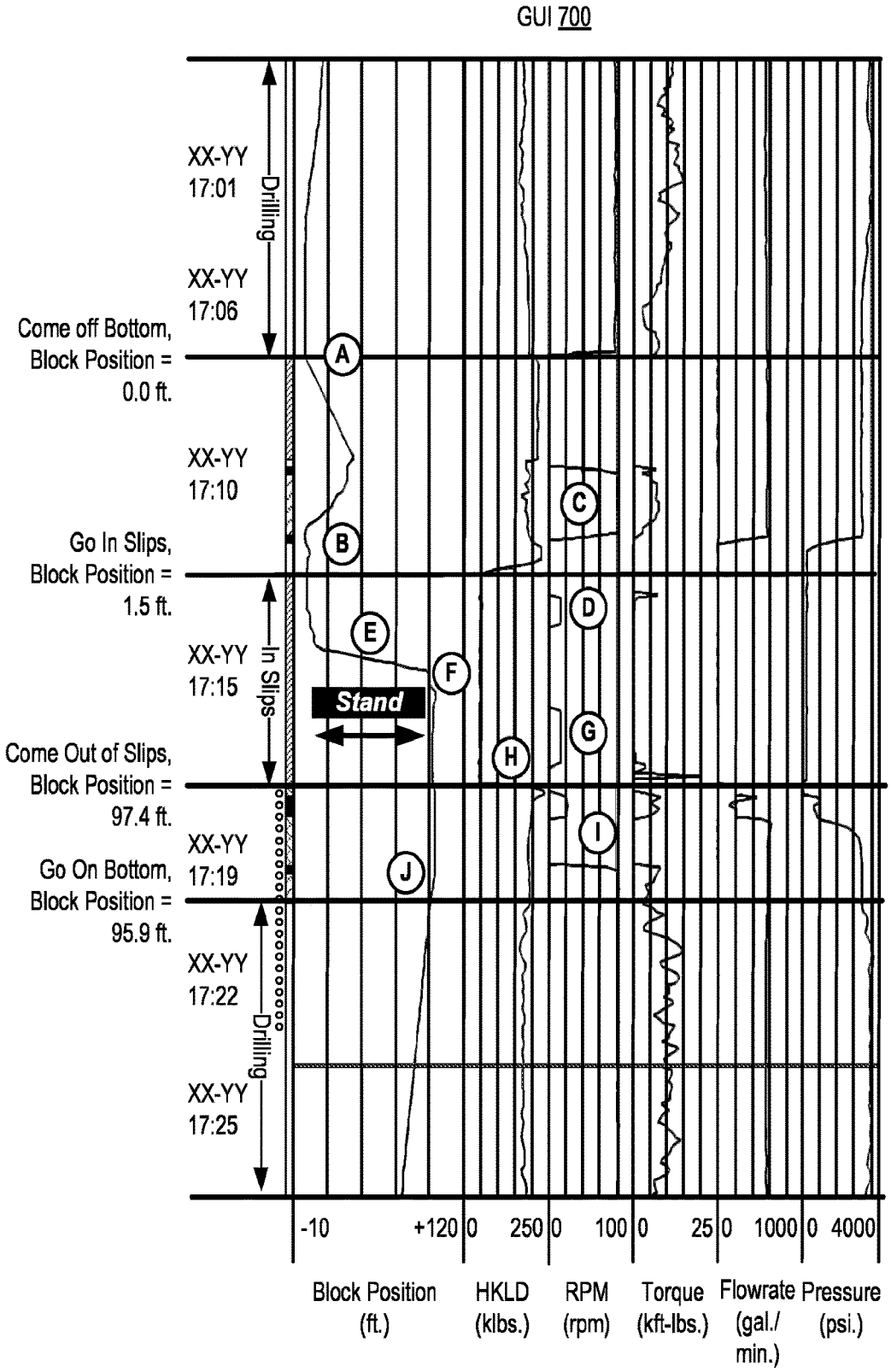
FIG. 7 illustrates an example of a graphical user interface.

FIG. 7 shows an example graphical user interface (GUI) 700 that includes channels of data as acquired over a period of time ranging from approximately 17:00 to approximately 17:27, which is approximately 27 minutes (e.g., just under one half of an hour). In the example shown, various positions of a block are indicated (e.g., BPOS channel) with respect to slips (e.g., slips status channel) and a drill bit and bottom of a hole. As shown, when the drill bit is lifted off bottom, the block position is at 0 ft (approximately 17:07:30), which can be a relative reference position (e.g., a null position for a method); when the operation is going in slips (e.g., in-slips state), the block position is at 1.5 ft (approximately 17:12:45); when the operation is coming out of slips, the block position is at 97.4 ft (approximately 17:18); and when the operation has the drill bit back on bottom, the block position is 95.9 ft (17:20:45). Thus, the in-slips time runs from approximately 17:12:45 to 17:18:00, which is approximately 5 minutes and 15 seconds. During the in-slips time period (e.g., in-slips state), the operation can be out of an automated drilling mode. For example, the operation can be in a manual mode or a semi-automated mode under control of a pipe handling system. As an example, an operation can include two separate modes of operation, one being an automated drilling mode that runs slips-to-slips and another being a pipe handling mode. As explained above, a method can include operating an automated system (e.g., an auto driller) during an in-slips time period, for example, to acquire data for one or more automated drilling operations controlled by the automated system.

As shown in FIG. 7, various events are labeled A to J. The event A corresponds to an end of drilling of a stand where the block position is at 0.0 ft. The events B and C can be related and pertain to pulling the drillstring upwardly while rotating, which can be performed while flowrate and pressure drop (e.g., stopping circulation). Upon going in-slips, the block position is at 1.5 ft and as the weight of the drillstring is supported by the slips, the hookload drops. The event D can correspond to rotation that can act to decouple equipment (e.g., consider decoupling of a drive, etc.). The event E corresponds to raising the block position such that a stand can be added to the drillstring, as indicated by event F. The event G can correspond to rotation that can act to couple equipment (e.g., consider coupling of a drive, coupling of a stand to a drillstring, etc.). The event H corresponds to the change in hookload as the drillstring comes out-of-slips, where the block position is at 97.4 ft. As explained, when coming out-of-slips, the drill bit is not on bottom; rather, the drill bit is a distance off bottom, which may be approximately 1.5 ft, as determined by the difference between the block position of 0.0 ft (coming off bottom) and the block position of 1.5 ft (going in-slips). Before going on bottom, as indicated by the event I, rotation commences along with circulation (see, e.g., flowrate and pressure) followed by a decrease in the block position as indicated by the event J, where the rotating drill bit engages bottom (see block position of 95.9 ft) to continue drilling of the borehole a distance that is approximately equal to the length of the stand that was added during the in-slips period.

As explained, an automated drilling mode can depend on a manually determined distance as to bottom. As an example, a method can include determining automatically a distance as to bottom using block position. Such a method can provide a bit on bottom status computed from block position. In such a method, during a formerly passive period (e.g., in-slips period) of an automated driller, the automated driller can be active by tracking block position where such tracking can be utilized to determine one or more distances for accurately returning a bit to bottom for drilling. Such an approach can help to reduce risk of jamming a bit into a bottom of a borehole due to an inaccurate distance (e.g., due to human inaccuracy, human error, etc.).

As an example, a method can include rendering an automatically determined distance to a graphical user interface (GUI) of a display where a driller may compute a manually determined distance for comparison. In such an approach, a driller may have an option to select one of the distances and/or to determine another distance value. For example, if the manually determined distance is greater than the automatically determined distance, then the shorter automatically determined distance may be utilized as it can provide for some assurances that the bit will not be jammed into the bottom of the hole after comping out-of-slips; whereas, if the manually determined distance is less than the automatically determined distance, then the driller may utilize the manually determined distance to instruct the automated driller to return the bit to the bottom of the hole. In such examples, there may be some amount of error as a distance to move the bit before engaging the bottom of the hole; however, such a distance can be traversed while the drillstring is moving at an approximate, expected rate of penetration such that engagement is relatively smooth, which can preserve bit life (e.g., bit integrity).

As an example, a method can include determining two distances and selecting the lesser distance for use by an automated driller to return a bit to a bottom of a hole after adding a section of pipe (e.g., or sections of pipe, etc.).

As to a manual method of determining a distance as to on bottom, it may be determined by bit depth and hole depth, for example, as recorded manually using a ledger (e.g., pen and paper, a spreadsheet, etc.). In such an approach, information may be communicated verbally (e.g., a person calling out a measurement of pipe, etc.) and recorded as best understood by a listener. In such an approach, rounding of fractions, decimals, etc., may occur, which can be subjective. In a manual approach, a driller may attempt to manipulate values such that there is a match to a pipe tally. As explained, an inaccurate on bottom status during automation can lead to bit damage and/or undesirable wear (e.g., wear in excess of expected wear, etc.). In an automated approach, there can be a distance that is determined without dependency on hole and bit depth where, instead, block position is utilized, which can be more robust as block position can be an automatically acquired data channel that is seldom manipulated. Block position can be utilized to compute on bottom status in a manner that isolates the on bottom status from bit and/or hole depth manipulations.

Systems that automate going on bottom can benefit from an accurate estimate of where bottom is to reduce risk of bit damage and/or excessive wear. If the bottom is higher than actual, such an automated system may still be running at a fast speed when bottom is reached, damaging the bit; whereas, if the bottom position is lower than actual, such an automated system may try to apply weight on bit and accelerate the speed of the bit thinking it is on bottom. As mentioned, the bottom being higher than actual can be damaging to a bit, particularly if readings are consistently higher than actual such that a bit is repeatedly subjected to inappropriate speed bit and rock engagements.

As to block position, rigsite equipment can generate a block position channel, which may be referred to as BPOS, which may be defined about a deadpoint (e.g., zero point) and may have deviations from that deadpoint in positive and/or negative directions. For example, consider a block that can move in a range of approximately −5 meters to +45 meters, for a total excursion of approximately 50 meters. In such an example, a rig height can be greater than approximately 50 meters (e.g., a crown block can be set at a height from the ground or rig floor in excess of approximately 50 meters). In the example GUI 700 of FIG. 7, the BPOS channel is given with respect to time (vertical axis) along a scale (horizontal axis) that runs from −10 feet to +120 feet, for a total of 130 feet (e.g., approximately 40 meters). Such a range of the BPOS channel can be within physical, constrained limits of a block, which can be operable to connect lengths of pipe of 90 feet, 30 meters, etc. (e.g., or less and slightly more). While various examples are given for land-based field operations (e.g., fixed, truck-based, etc.), various methods can apply for marine-based operations (e.g., vessel-based rigs, platform rigs, etc.).

In the example of FIG. 7, other channels include hookload (HKLD) in a range of 0 to 250 klbs, rotational speed (RPM) in a range from 0 to 100 rpm, torque in a range from 0 to 25 kft-lbs, flowrate in a range of 0 to 1000 gallons per minute and pressure in a range of 0 to 4000 pounds per square inch (psi). As an example, drilling operations can include making one or more adjustments to equipment such that one or more changes occur in one or more of such physical parameters.

Figure 8:
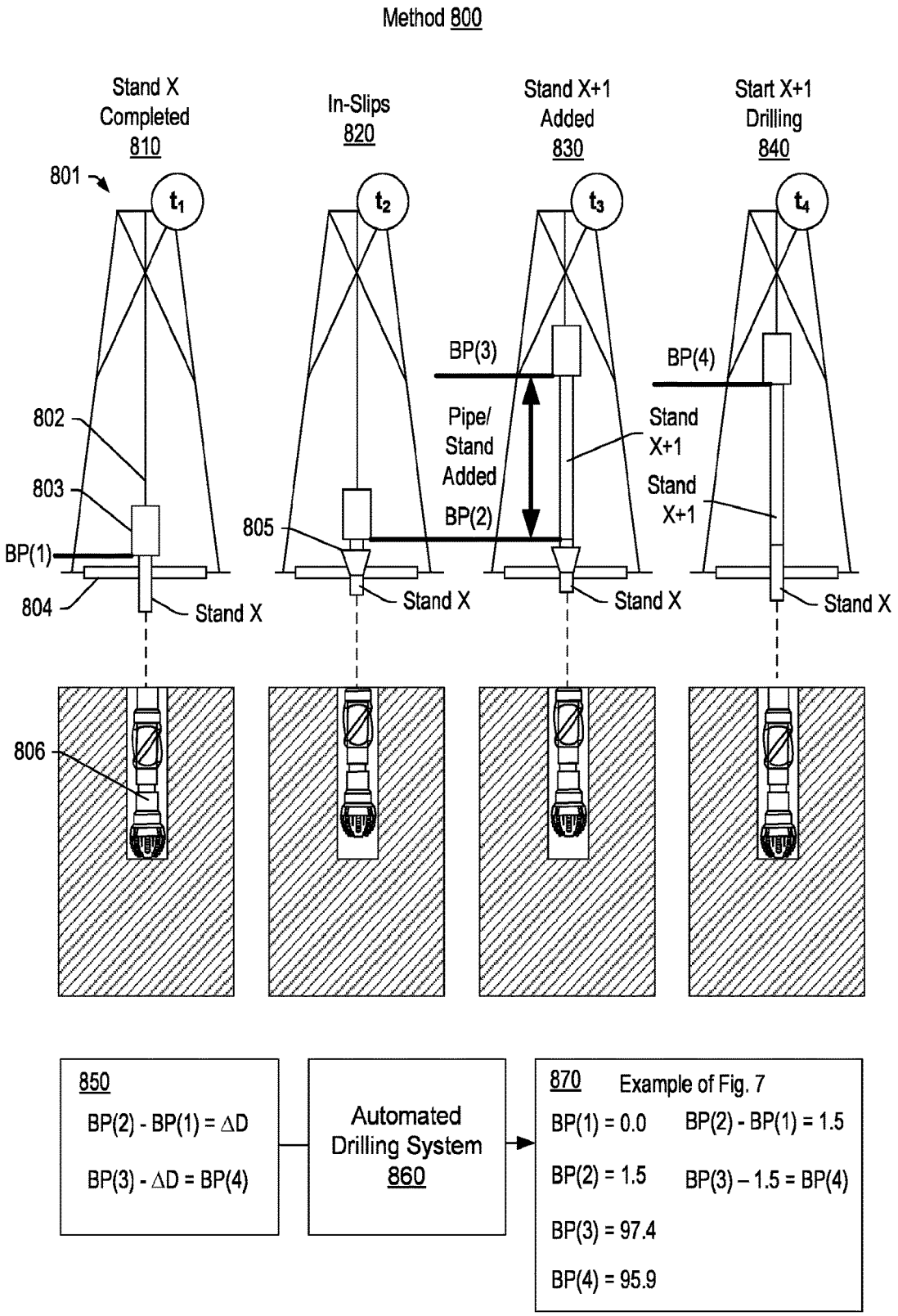
FIG. 8 illustrates an example of a method and an example of a system.

FIG. 8 shows an example of a method 800 that utilizes drilling equipment to perform drilling operations. As shown, the drilling equipment includes a rig 801, a lift system 802, a block 803, a platform 804, slips 805 and a bottom hole assembly 806. As shown, the rig 801 supports the lift system 802, which provides for movement of the block 803 above the platform 804 where the slips 805 may be utilized to support a drillstring that includes the bottom hole assembly 806, which is shown as including a bit to drill into a formation to form a borehole.

As to the drilling operations, they include a first operation 810 that completes a stand (Stand X) of the drillstring; a second operation 820 that pulls the drillstring off the bottom of the borehole by moving the block 803 upwardly and that supports the drillstring in the platform 804 using the slips 805; a third operation 830 that adds a stand (Stand X+1) to the drillstring; and a fourth operation 840 that removes the slips 805 and that lowers the drillstring to the bottom of the borehole by moving the block 803 downwardly. Various details of examples of equipment and examples of operations are also explained with respect to FIGS. 1, 2, 3, 4 and 5.

In the example method 800 of FIG. 8, various block positions are indicated using thick horizontal lines for BP(1), BP(2), BP(3) and BP(4). FIG. 8 also shows an example of an automated drilling system 860 that can receive input 850 and provide output 870, which can include various outputs as illustrated in the GUI 700 of the example of FIG. 7. As shown, input 850 can include receiving block position data and/or relationships (e.g., position of the block 803 in the method 800), which can be marked (e.g., tagged using slips status, timestamps, etc.). As explained above with respect to the GUI 700 of FIG. 7, when the drill bit is lifted off bottom, the block position is at 0 ft (approximately 17:07:30) as indicated by BP(1)=0.0 in the output 870, which can be a relative reference position (e.g., a null position for a method); when the operation is going in slips (e.g., in-slips state), the block position is at 1.5 ft (approximately 17:12:45) as indicated by BP(2)=1.5 in the output 870; when the operation is coming out of slips, the block position is at 97.4 ft (approximately 17:18) as indicated by BP(3)=97.4 in the output 870; and when the operation has the drill bit back on bottom, the block position is 95.9 ft (17:20:45) as indicated by BP(4)=95.9 in the output 870.

As shown in the example of FIG. 8, an automated drilling system (e.g., an auto driller) can operate using block position and slips status for improving drilling operations. As explained, such an automated drilling system can output bit on bottom status, which can be an improved bit on bottom status that can improve drilling operations (e.g., via one or more of lesser risk of damage, lesser wear, greater ROP, lesser NPT, etc.).

Figure 9:
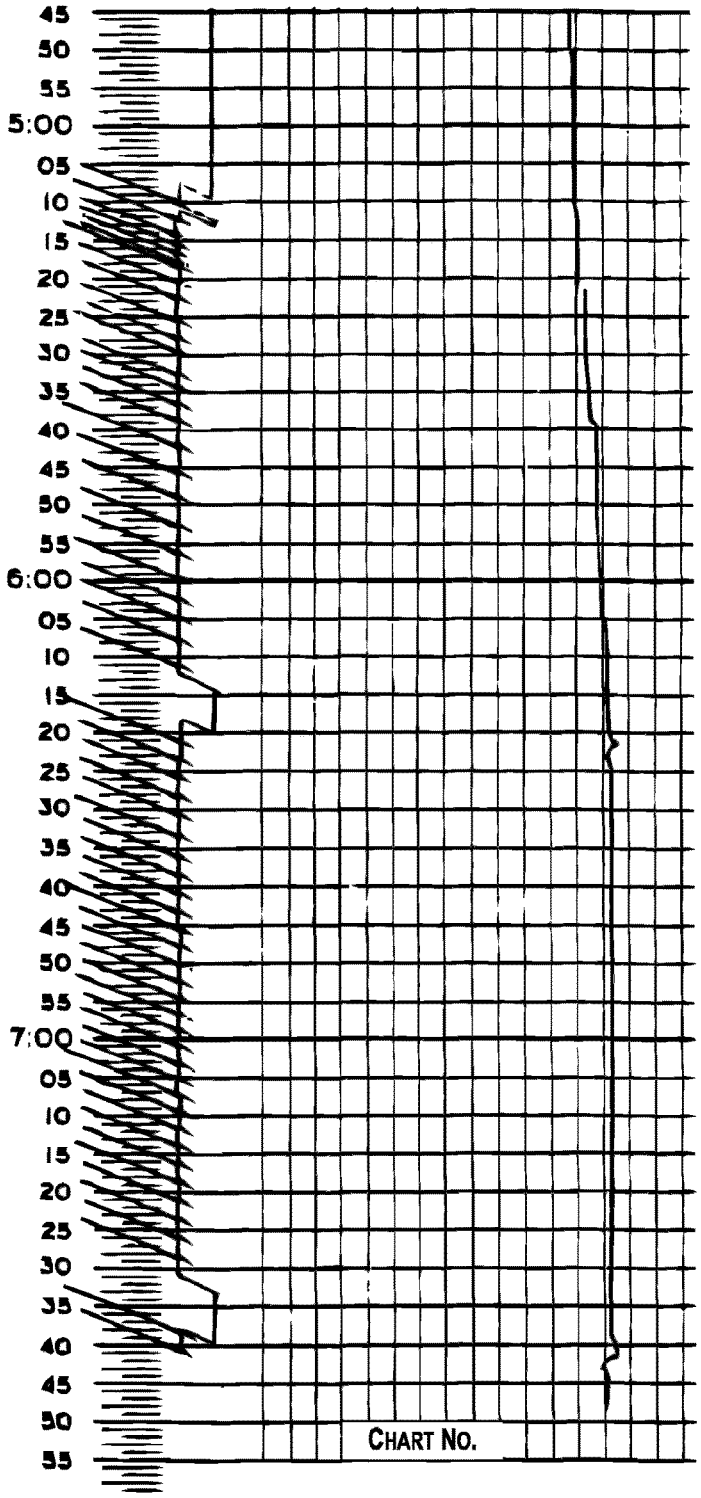
FIG. 9 illustrates an example of a method using a geolograph chart.

FIG. 9 shows an example of a method 900 with respect to a chart, which may be numbered with a chart number (e.g., by hand, etc.). In the example of FIG. 9, the chart can be a geolograph or a geolograph chart. As mentioned, a geolograph can be utilized for purposes such as calculating a rate of penetration (ROP), for example, by measuring the length of time to drill 1 ft of depth, which may be performed by reading a chart on the geolograph (e.g., a geolograph chart).

A geolograph mechanically monitors depth and records drilling parameters in time. These parameters are recorded on a paper chart, graduated in minutes, that is wrapped around a drum. The drum rotates one revolution in 8, 12, or 24 hr. To record depth, a small cable is run from the geolograph to the top of a kelly via a pulley on a crown of a derrick (see, e.g., FIG. 2). The kelly height can then be measured and directly related to bit depth. As each foot is drilled, an ink pen on the geolograph places a small mark on the chart. In such an approach, for each 5 ft, the pen places a larger mark on the chart.

Operation of a geolograph can introduce errors. For example, when a connection is made, a driller can be instructed to disengage the geolograph recorder before picking up a new joint of pipe. The recorder is then to be reengaged when drilling resumes. Unless this operation is performed properly, rate of penetration just prior to or after a connection can be questionable. In addition, high winds can whip a geolograph recording cable, causing extra footage to be recorded, which can result in an apparent increase in ROP. Further, where a driller or other operator places a hand to "gig" or pull on the recording cable, a similar apparent increase in ROP can result.

One or more other sources of error can include hole fill, pipe stretch, sticking pipe, etc., where a subjective effort may be made as to one or more of such errors to be "backed out" where the effort aims to maintain a more accurate depth record (e.g., measured depth). The depth can be checked by periodically strapping out of the hole (each stand is measured with a steel tape as it is pulled or tripped out of the hole) and making a depth adjustment to the geolograph. However, such a process can be time consuming (e.g., generate NPT), waste resources and still include substantial error(s).

Figure 10:
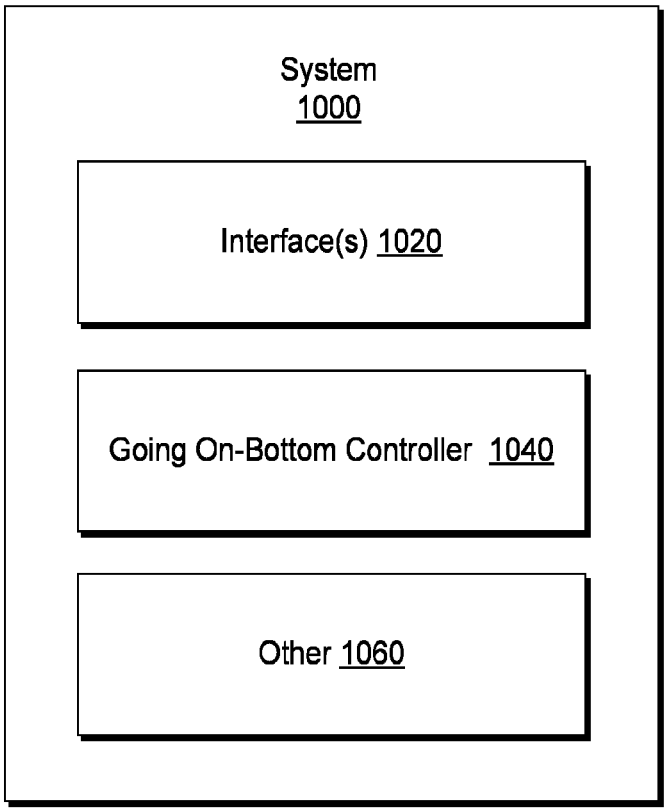
FIG. 10 illustrates an example of a system.

FIG. 10 shows an example of a system 1000 that includes one or more interfaces 1020, a going on-bottom controller 1040 and one or more other components 1060. The system 1000 may operate to receive slips status and block position data via the one or more interfaces 1020 where the going on-bottom controller 1040 can control a going on-bottom process that lands a drill bit of a drillstring on a bottom of a borehole.

As an example, the system 1000 may be included in and/or operatively coupled to a system such as the system 200 of FIG. 2, the system 300 of FIG. 3, the system 400 of FIG. 4, the system 860 of FIG. 8, etc. As an example, the system 1000 may be operatively coupled to a GUI or GUIs such as, for example, the GUI 500 of FIG. 5, where one or more of block position, slips status and on bottom status may be rendered, optionally with respect to a representation of a trajectory of a borehole that may include a representation of a drillstring that includes a BHA.

As an example, the system 1000 may be operated using one or more application programming interfaces (APIs) where, for example, calls and responses may be made. For example, a controller can issue one or more calls for block position data, slips status, etc., where, in response, such data and/or status can be returned. In such an example, using returned data and/or status, the controller can control position of a drillstring with respect to time to land a drill bit of the drillstring. In such an example, where the controller can receive and/or determine a rate of penetration, a velocity of the drill bit may be controlled using the rate of penetration, which may provide for a "soft" landing that aims to optimize one or more aspects of drilling (e.g., reduced NPT, reduced wear of a bit, etc.). As an example, the one or more other components 1060 can include one or more components for control of one or more other types of rigsite equipment (e.g., slips, pumps, top drive, rotary table, etc.). As an example, the going on-bottom controller 1040 can be operatively coupled to drawworks and/or one or more other pieces of rigsite equipment.

As to block position, one or more sensors may be utilized that can acquire block position data such as, for example, values of BP(1), BP(2) and BP(3) where BP(4) may be calculated using BP(1), BP(2) and BP(3). For example, consider the output 870 of FIG. 8, which may be understood with reference to the method 800 of FIG. 8 and the GUI 700 of FIG. 7.

As explained, in drilling operations, the length of the drillstring may be tracked manually using a tally (e.g., pen and paper, a spreadsheet, etc.). As explained, where a driller tabulates the length of the drillstring and uses the length as a proxy for the bottom depth of a borehole, if either value is inaccurate (e.g., not tracked properly), a driller or automated driller may run the drillstring into rock at an accelerated rate as the driller or automated driller may not realize that the bottom of the hole is approaching, which can potentially cause severe equipment damage and operational problems.

In various instances, drillstring length is measured using an encoder at the drawworks of a rig. As explained, the drawworks can be a winch that controls the raising and lowering of the block, which adjusts the elevation of a top drive or a kelly and the drillstring attached thereto. An encoder may be configured to record revolutions of a drum of the drawworks where the revolutions are utilized to determine a distance that the block has been lowered. When a stand is fully deployed, the block can be raised again using the drawworks, and the process can be repeated. Drawworks encoder measurements may have various types of error. For example, consider errors caused by radius of the layer of drill line relative to the center of the drawworks, the stretch of drill line under the hookload (which itself may fluctuate, e.g., by downhole pressures, etc.), and the like. In some instances, a geolograph line is used to calibrate a drawworks encoder. A geolograph line is a cable that is attached directly to a top drive, a kelly or a block. A cable retrieval system for the cable can be provided, along with an encoding sensor, where both can be attached to a fixed point on or near the rig floor. The geolograph line then travels up and down the derrick while the encoder measures the amount of line being paid out or retrieved. However, the measurements taken by the drawworks, even as calibrated by the geolograph line, may include error and thus uncertainty in a depth measurement.

As shown in FIG. 2, the wellsite system 200 (e.g., a rigsite system or rigsite equipment) can include various sensors 264, which may be types of detectors, data acquisition sensors, etc., for purposes of one or more of slips status and block position. As mentioned, block position data may be tracked via one or more cameras, one or more sensors, etc. A US Patent Application Publication having Publication No. US 2017/0167853 A1, to Zheng et al., (Schlumberger Technology Corporation), published 15 Jun. 2017 is incorporated by reference herein, which describes position measurement.

As an example, an optical sensor, such as a camera, may be configured to detect and distinguish markers, which can include stationary and moving markers. As an example, markers may be disposed at predetermined elevations along a rigsite system and may be positioned on a block, a top drive, etc. In such an example, elevation of a block (e.g., above a rig floor) may be determined.

As to block position, equipment at a rigsite system can be utilized to for determining block position at a resolution less than approximately several centimeters, which may be less than one inch. As to sampling rate, sampling may be at a frequency greater than approximately 1 Hz (e.g. greater than once per second or at a millisecond rate, etc.).

As an example, a rangefinder approach may be utilized to track block position. For example, consider one or more electromagnetic energy-based rangefinders. As an example, a block, top drive, etc., can include a reflector that reflects EM radiation as emitted by a laser, etc., where a detector can analyze reflected EM radiation (e.g., and/or received EM radiation) for purposes of determining a block position. As an example, a block, a top drive, etc., can include a laser or lasers that can emit radiation toward one or more other components (e.g., upwardly, downwardly, etc.) where transmitted and/or reflected energy can be analyzed for purposes of determining block position.

Figure 11:
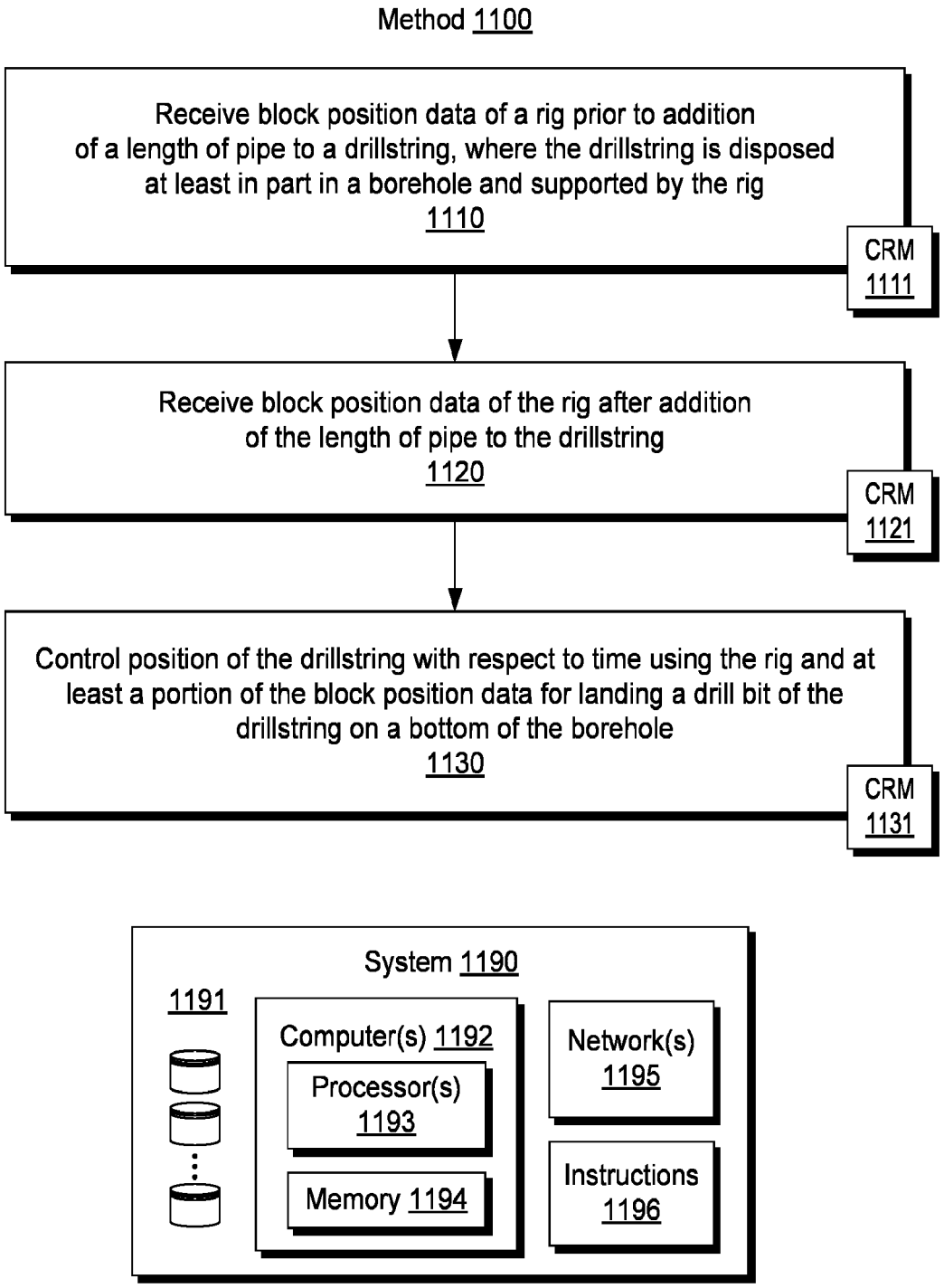
FIG. 11 illustrates an example of a method and an example of a system.

FIG. 11 shows an example of a method 1100 and an example of a system 1190. As shown, the method 1100 can include a reception block 1110 for receiving block position data of a rig prior to addition of a length of pipe to a drillstring, where the drillstring is disposed at least in part in a borehole and supported by the rig; a reception block 1120 for receiving block position data of the rig after addition of the length of pipe to the drillstring; and a control block 1130 for controlling position of the drillstring with respect to time using the rig and at least a portion of the block position data for landing a drill bit of the drillstring on a bottom of the borehole.

The method 1100 is shown as including various computer-readable storage medium (CRM) blocks 1111, 1121 and 1131 that can include processor-executable instructions that can instruct a computing system, which can be a control system, to perform one or more of the actions described with respect to the method 3800.

In the example of FIG. 11, a system 1190 includes one or more information storage devices 1191, one or more computers 1192, one or more networks 1195 and instructions 1196. As to the one or more computers 1192, each computer may include one or more processors (e.g., or processing cores) 1193 and memory 1194 for storing the instructions 1196, for example, executable by at least one of the one or more processors 1193 (see, e.g., the blocks 1111, 1121 and 1131). As an example, a computer may include one or more network interfaces (e.g., wired or wireless), one or more graphics cards, a display interface (e.g., wired or wireless), etc.

As an example, the method 1100 of FIG. 11 may be utilized for determining a bit on bottom status using a limited amount of sensor data and/or data derived from one or more sensors. For example, consider determining bit on bottom status using block position data and in slips status, without utilization of other information.

As an example, the method 1100 of FIG. 11 can be an improved technique when compared to determining bit on bottom status from tabulated bit and hole depths where a driller tends to adjust depths (e.g., often with some considerable amount of error) at each connection to match to a pipe tally. Such an approach can result in the bit on bottom status being indicated when the bit is actually a distance off bottom. Given a bit on bottom status, a rig system will act to apply weight to a drillstring for drilling to crush rock using a bit at the end of the drillstring. Where the bit is in reality not on bottom, a distance exists between the bit and the bottom of the hole (e.g., as formed by rock) such that application of weight to the drillstring causes acceleration of the drillstring over that distance, which accelerates the bit towards the actual bottom. As explained, a formation can be formed of rock, which can be of a particular hardness. Acceleration of a bit over a distance by inappropriate application of weight to a drillstring responsive to an erroneous bit on bottom status can cause the bit to impact rock with considerable force (e.g., F=ma) and momentum (e.g., p=my). The distance between the bit and bottom of the hole can allow the drillstring to accelerate and gain velocity. Thus, a greater error in bit on bottom status can result in greater force and momentum, which can result in a greater risk of damage and/or wear to a bit. While damage and/or wear to a bit is mentioned, impact of a bit hitting bottom with substantial force and momentum may increase risk of damage and/or wear to one or more other components of a drillstring and/or a borehole (e.g., directly and/or indirectly). For example, force and/or momentum of impact may cause damage to a downhole motor, one or more downhole sensors, etc. In some instances, a drillstring may buckle. Such issues can result in considerable non-productive time (NPT), re-planning, unscheduled tripping (e.g., tripping out to replace a bit, etc., followed by tripping in), etc.

Another issue that can arise from determining bit on bottom status from tabulated bit and hole depths where a driller tends to adjust depths (e.g., often with some considerable amount of error) at each connection to match to a pipe tally is the bit reaching actual bottom some distance before status changes to a bit on bottom status (e.g., a late determination of bit on bottom). In such a scenario, a rig system may continue at running to bottom speeds effectively packing excessive weight on the bit and damaging and/or excessively wearing the bit.

As explained, a method such as, for example, the method 1100 of FIG. 11 can be an improved technique for operations that helps to isolate one or more of such operations from errors in driller manipulating depths. With less error in bit on bottom status, operations can be improved. For example, less bit wear may occur such that, during drilling of a section, where sufficient bit life exists (e.g., due to less bit wear), the drilling may be performed at a higher rate of penetration (ROP) for at least a portion of that section. In such an example, drilling can occur using a method such as the method 1100 where bit wear is lessened and bit life preserved. Once a depth (e.g., measured depth, number of stands, etc.) has been reached, drilling may be performed with an increased ROP as the risk of wearing out the bit before reaching the end of the section is lessened. In such an example, a schedule may call for tripping out the drillstring and, for example, replacing at least a portion of a BHA (e.g., a bit, etc.) to prepare for drilling another section, which may be, for example, a smaller diameter borehole section (e.g., section diameter can decrease in a section-by-section manner as measured depth increases).

As mentioned, operations can include tripping out and tripping in, which can be referred to as a round trip. A round trip involves removing a drillstring from a borehole and running it back in the borehole. A round trip can be planned or may be demanded responsive to one or more types of issues. For example, consider calling for a round trip when a bit becomes dull or broken, and no longer drills the rock efficiently. After some preliminary preparations for a trip, a rig crew removes the drillstring stand-by-stand (e.g., 90 ft or approximately 27 m) at a time, for example, by unscrewing every third drillpipe or drill collar connection. In such an example, when the three joints are unscrewed from the rest of the drillstring, they can be stored upright in a derrick by fingerboards at the top and careful placement on planks on the rig floor. After a drillstring has been removed from a borehole, a dull bit can be unscrewed with the use of a bit breaker and, for example, examined to help determine why the bit dulled or failed. Depending on the failure mechanism, the crew might choose a different type of bit prior to tripping in. If bearings on the prior bit failed, but the cutting structures are still sharp and intact, the crew may opt for a faster drilling (less durable) cutting structure. Conversely, if the bit teeth are worn out but the bearings are still sealed and functioning, the crew may choose a bit with more durable (and less aggressive) cutting structures. Once the bit is chosen, it is screwed onto the bottom of the BHA with the help of the bit breaker and the drillstring is run into the hole (RIH), stand-by-stand being reassembled. Once an on bottom status determination has been made, drilling can commence. The duration of such a round trip can depend on various factors, such as, for example, the total depth of the well and the skill of the rig crew. An estimate for a competent crew is that the round trip demands one hour per thousand feet of borehole, plus an hour or two for handling various drillstring components (e.g., collars and bits). At that rate, a round trip in a ten thousand-foot well might take twelve hours. A round trip for a 30,000 ft (e.g., 9230 m) well might take 32 or more hours, especially if intermediate hole-cleaning operations must be undertaken.

As explained, a method such as the method 1100 of FIG. 11 can improve operations. For example, such a method can improve operations by reducing risk of having to perform an unscheduled round trip and/or having to perform a scheduled round trip early, which may impact a remaining portion of a schedule (e.g., as to one or more sections yet to be drilled, etc.).

Figure 12:
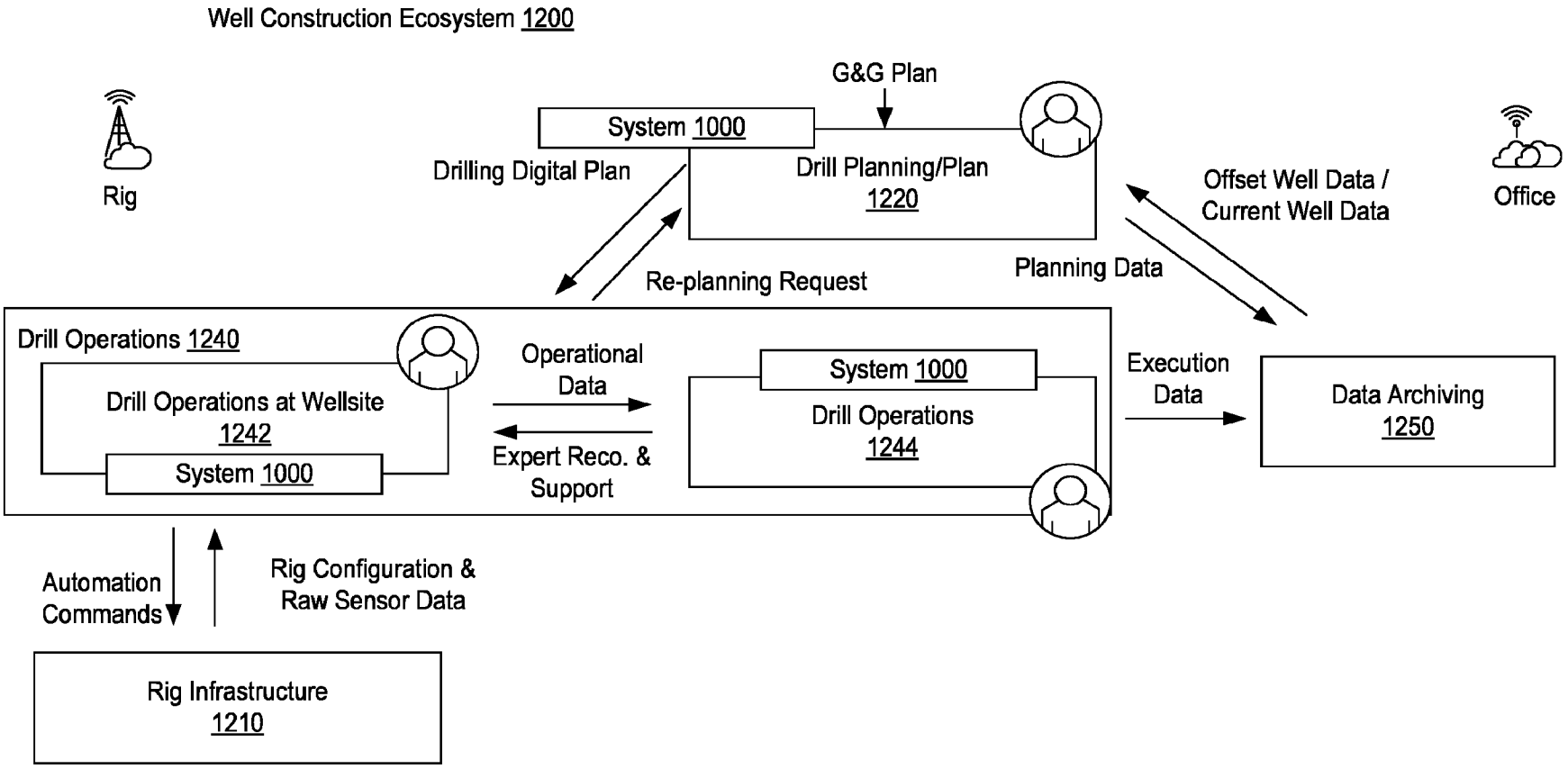
FIG. 12 illustrates an example of a well construction ecosystem that includes one or more systems.

FIG. 12 shows an example of a system 1200 that can be a well construction ecosystem. As shown, the system 1200 can include one or more instances of the system 1000 and can include a rig infrastructure 1210 and a drill plan component 1220 that can generation or otherwise transmit information associated with a plan to be executed utilizing the rig infrastructure 1210, for example, via a drilling operations layer 1240, which includes a wellsite component 1242 and an offsite component 1244. As shown, data acquired and/or generated by the drilling operations layer 1240 can be transmitted to a data archiving component 1250, which may be utilized, for example, for purposes of planning one or more operations (e.g., per the drilling plan component 1220).

As mentioned, data acquired for purposes of going on-bottom may be utilized for one or more other purposes, which can include, for example, assessing data as to measured bit depth, data as to measured hole depth (HD), etc. In such examples, one or more aspects of a digital well plan may be adjusted and/or an auto driller adjusted. For example, where a mismatch exists in various depth (e.g., length) data, a reconciliation process can be performed, which may include calling for a survey (e.g., a downhole survey), which may improve ability to accurately locate a position of a bottom hole assembly (BHA) of a drillstring. As an example, an auto driller (e.g., a system such as the system 1000) can include features that can determine whether or not a survey to acquire survey data is likely to improve drilling operations.

In the example of FIG. 12, the system 1000 is shown as being implemented with respect to the drill plan component 1220, the wellsite component 1242 and/or the offsite component 1244. As shown in FIG. 12, various components of the drilling operations layer 1240 may utilize the system 1000. During drilling, execution data can be acquired, which may be utilized by the system 1000. Such execution data can be archived in the data archiving component 1250, which may be archived during one or more drill operations and may be available by the drill plan component 1220, for example, for re-planning, etc.

As explained, drilling can increase the depth of a bore. As an example, during non-drilling (e.g., a non-drilling state), flow rate of fluid being pumped into a drillstring may increase and/or decrease, rate of rotation of a drillstring may increase and/or decrease, a drill bit may move upwards and/or downwards, or a combination thereof.

As an example, pre-connection can refer to a state where a drill bit has completed drilling operations for a current section of pipe, etc., but the slips assembly has not begun to move (e.g., radially-inward) into engagement with the drillstring. During pre-connection, the flow rate of fluid being pumped into the drillstring may increase and/or decrease, the rate of rotation of the drillstring may increase and/or decrease, the drill bit may move upwards and/or downwards, or a combination thereof.

As an example, connection can refer to a state where a slips assembly is engaged with, and supports, a drillstring (e.g., the drillstring is "in-slips"). When a connection is occurring, a segment (e.g., a pipe, a stand, etc.) may be added to the drillstring to increase the length of the drillstring, or a segment may be removed from the drillstring to reduce the length of the drillstring.

As an example, post-connection can refer to a state where the drillstring is released by a slips assembly and the drillstring with a drill bit is lowered to be on-bottom (e.g., bottom of hole or BOH). During post-connection, the flow rate of fluid being pumped into a drillstring may increase and/or decrease, the rate of rotation of a drillstring may increase and/or decrease, the drill bit may move upwards and/or downwards, or a combination thereof.

As mentioned, a length of pipe can be a stand, which may be, for example, approximately 90 ft or approximately 30 m (e.g., approximately 27 m), and formed from individual pipes connected together to form the stand. As an example, a length of pipe can be greater than approximately 5 meters and less than approximately 100 meters.

As an example, a method can include receiving block position data of a rig prior to addition of a length of pipe to a drillstring, where the drillstring is disposed at least in part in a borehole and supported by the rig; receiving block position data of the rig after addition of the length of pipe to the drillstring; and controlling position of the drillstring with respect to time using the rig and at least a portion of the block position data for landing a drill bit of the drillstring on a bottom of the borehole. In such an example, the method can include receiving a signal indicative of slips status of slips that support the drillstring during an in-slips state.

As an example, a method can include controlling position of a drillstring with respect to time by controlling velocity of the drillstring in an in-hole direction based at least in part on a computed distance between a drill bit of the drillstring and a bottom of the borehole, where the computed distance is based at least in part on at least a portion of block position data, which can include block position data prior to addition of a length of pipe to a drillstring and block position data after addition of the length of pipe to the drillstring.

As an example, a method can include implementing an auto driller as a computerized drilling system that can issue instructions for various drilling operations in an automated manner, for example, for going on-bottom after a length of pipe is added to a drillstring. Such a computerized drilling system can include one or more processors, memory accessible thereto, and processor-executable instructions to instruct equipment to perform one or more automated drilling operations and, for example, to acquire data germane thereto (e.g., slip status, block position data, etc.).

As an example, block position data can be received by an auto driller where the auto driller performs controlling of position of a drillstring with respect to time. As mentioned, control can include controlling position, controlling acceleration, controlling direction, controlling velocity, etc. As explained, control can include reducing velocity of a drill bit along a length of a borehole based on at least in part on distance of the drill bit from a bottom of the borehole, which can be a computed distance that is based on block position data, which can be or include block position data acquired prior to reducing the velocity. As an example, a reduced velocity may be approximately equal to a rate of penetration, which may be an estimated rate of penetration, a received rate of penetration, etc. As to a distance that can be a trigger for reducing velocity, such a distance may be a fraction of a greater distance, a percentage of a greater distance, a predetermined distance, etc., which can provide for time to reduce velocity and optionally a safety margin. For example, a safety margin can cause a reduction in velocity at least a predetermined distance from a bottom of a borehole that is based on a determined distance with respect to the bottom of the borehole using block position data such that if an error exists in the determined distance with respect to the bottom of the borehole, the risk of jamming a drill bit into the formation at a velocity greater than the reduced velocity is lessened, which can result in a slightly longer amount of time to reach the bottom of the borehole while, as a tradeoff, preserving drill bit operational life, etc.

As an example, a method can include controlling going on-bottom in a manner that is performed without using a manually measured bit depth value, without using a manually measured hole depth (HD) value and/or without using a manually measured bit depth value and without using a manually measured hole depth (HD) value. As an example, a going on-bottom operation may be performed in an automated manner without human intervention. For example, an auto driller can determine a distance to a bottom of a borehole from a drill bit using block position data as acquired for slips states and can control position of the drill bit with respect to time based at least in part on the distance, for example, to land the drill bit while the drill bit is rotating to continue drilling in a manner that lengthens the borehole such that a new bottom position results after the drilling (e.g., for a length of pipe, etc.).

As an example, a length of pipe can be a length of a stand, which can be, for example, a number of pipes coupled together.

As an example, block position data can include a reference block position value (BP(1)), an off-bottom block position value (BP(2)), and an in-slips added length of pipe block position value (BP(3)). In such an example, a method can include controlling position of a drillstring in a borehole that lands a drill bit of the drillstring on a bottom of the borehole by moving the drillstring a distance that corresponds to a block position (BP(4)) determined at least in part by subtracting the off-bottom block position value (BP(2)) from the in-slips added length of pipe block position value (BP(3)). As mentioned, a reference block position value (e.g., BP(1)) can be a null position; noting that a block position acquisition system may also utilize a null position where some values of block position are positive and some values of block position are negative. For example, the example of FIG. 7, the block position channel data are given in feet along a scale from −0 feet to +120 feet such that a zero point (e.g., deadpoint) exists. As an example, a zero point of a scale and a reference point can differ. For example, a reference point (e.g., BP(1)) may differ from the zero point of a BPOS channel scale. In such an example, the scale and/or scale values may be adjusted for purposes of determining a block position (e.g., BP(4), etc.).

As an example, a method can include receiving a rate of penetration and controlling a position of a drillstring with respect to time based at least in part on the rate of penetration. As an example, a method can include determining a rate of penetration and controlling a position of a drillstring with respect to time based at least in part on the rate of penetration.

As an example, block position data of a rig, prior to addition of a length of pipe to a drillstring, can include block position data for an on-bottom state of the drillstring that is prior to an in-slips state of the drillstring. For example, the block position of an on-bottom state can correspond to a deepest drill bit position along a borehole where the drill bit is assumed to be in contact with formation and where, for example, a block (e.g., or other traveling equipment) is at or near a lower limit with respect to a rig floor such that further drilling is contraindicated without addition of a length of pipe to the drillstring, which, as explained, involves raising the block to provide space (e.g., axial space) to connect the length of pipe to the drillstring.

As an example, block position data of a rig, prior to addition of a length of pipe to a drillstring, can be acquired responsive to actuation of an on-bottom state actuator. For example, consider an on-bottom state actuator that is manually actuated (e.g., a button, etc.). As an example, responsive to actuation of an on-bottom state actuator, a method may commence that can acquire block position data for non-drilling activities that involve adding a length of pipe to a drillstring where the block position data can be utilized to return a drill bit to a bottom of a borehole to continue drilling activities that deepen (e.g., lengthen) the borehole.

As an example, block position data of a rig after addition of a length of pipe to a drillstring can be for an in-slips state where, for example, a method can include transitioning the rig from the in-slips state to an out-of-slips state prior to controlling position of the drillstring with respect to time.

As an example, a method can include controlling slips of a rig and controlling position of a drillstring using the rig where controlling position can include controlling position with respect to time to move the drillstring outwardly and/or controlling position with respect to time to move the drillstring inwardly. As mentioned, a method can include pulling a drill bit off bottom prior to transitioning to an in-slips state and transitioning from the in-slips state to an out-of-slips state before controlling position of the drillstring with respect to time to land the drill bit on bottom (e.g., going on-bottom). As an example, a method can include controlling slips of a rig via a first transitioning from an out-of-slips state to an in-slips state and a second transitioning from the in-slips state to an out-of-slips state, where at least a portion of block position data is acquired in the out-of-slips state and where at least a portion of block position data is acquired in the in-slips state. In such an example, a distance can be determined for purposes of controlling position of the drillstring using the rig for going on-bottom in the out-of-slips state from the second transitioning.

As explained, various operations at a rigsite can be cyclical (see, e.g., the geolograph chart of FIG. 9. As mentioned, a method can be cyclical, which may be repeated in a state-based manner. For example, consider drilling states, non-drilling states, slips states, data acquisition states, etc., which can form a cycle where each cycle can include going on-bottom. As explained, a method for going on-bottom can be relative to a cycle such that going on-bottom for that cycle does not depend on block position data from a prior cycle; noting that block position data from a prior cycle may, in some instances be utilized (e.g., for analysis, for assessment, for rate of penetration determination, etc.).

As an example, a system can include a processor; memory accessible by the processor; processor-executable instructions stored in the memory and executable to instruct the system to: receive block position data of a rig prior to addition of a length of pipe to a drillstring, where the drillstring is disposed at least in part in a borehole and supported by the rig; receive block position data of the rig after addition of the length of pipe to the drillstring; and control position of the drillstring with respect to time using the rig and at least a portion of the block position data for landing a drill bit of the drillstring on a bottom of the borehole.

As an example, one or more computer-readable storage media can include processor-executable instructions to instruct a computing system to: receive block position data of a rig prior to addition of a length of pipe to a drillstring, where the drillstring is disposed at least in part in a borehole and supported by the rig; receive block position data of the rig after addition of the length of pipe to the drillstring; and control position of the drillstring with respect to time using the rig and at least a portion of the block position data for landing a drill bit of the drillstring on a bottom of the borehole.

As an example, one or more computer-readable storage media can include processor-executable instructions to instruct a computing system to perform one or more methods. As an example, a computer program product can include executable instructions that can be executable by a computing system to perform one or more methods. As an example, a computer program product can be runnable using a computer or computing system where such running produces a technical result, which can be, for example, a notification, a control command, etc., which may be utilized, directly and/or indirectly, to control one or more drilling operations. For example, consider a drilling operation for landing a drill bit of a drillstring on a bottom of a borehole using a rigsite system (e.g., a wellsite system, etc.).

As an example, a method may be implemented in part using computer-readable media (CRM), for example, as a module, a block, etc. that include information such as instructions suitable for execution by one or more processors (or processor cores) to instruct a computing device or system to perform one or more actions. As an example, a single medium may be configured with instructions to allow for, at least in part, performance of various actions of a method. As an example, a computer-readable medium (CRM) may be a computer-readable storage medium (e.g., a non-transitory medium) that is not a carrier wave.

According to an embodiment, one or more computer-readable media may include computer-executable instructions to instruct a computing system to output information for controlling a process. For example, such instructions may provide for output to sensing process, an injection process, drilling process, an extraction process, an extrusion process, a pumping process, a heating process, etc.

Figure 13:
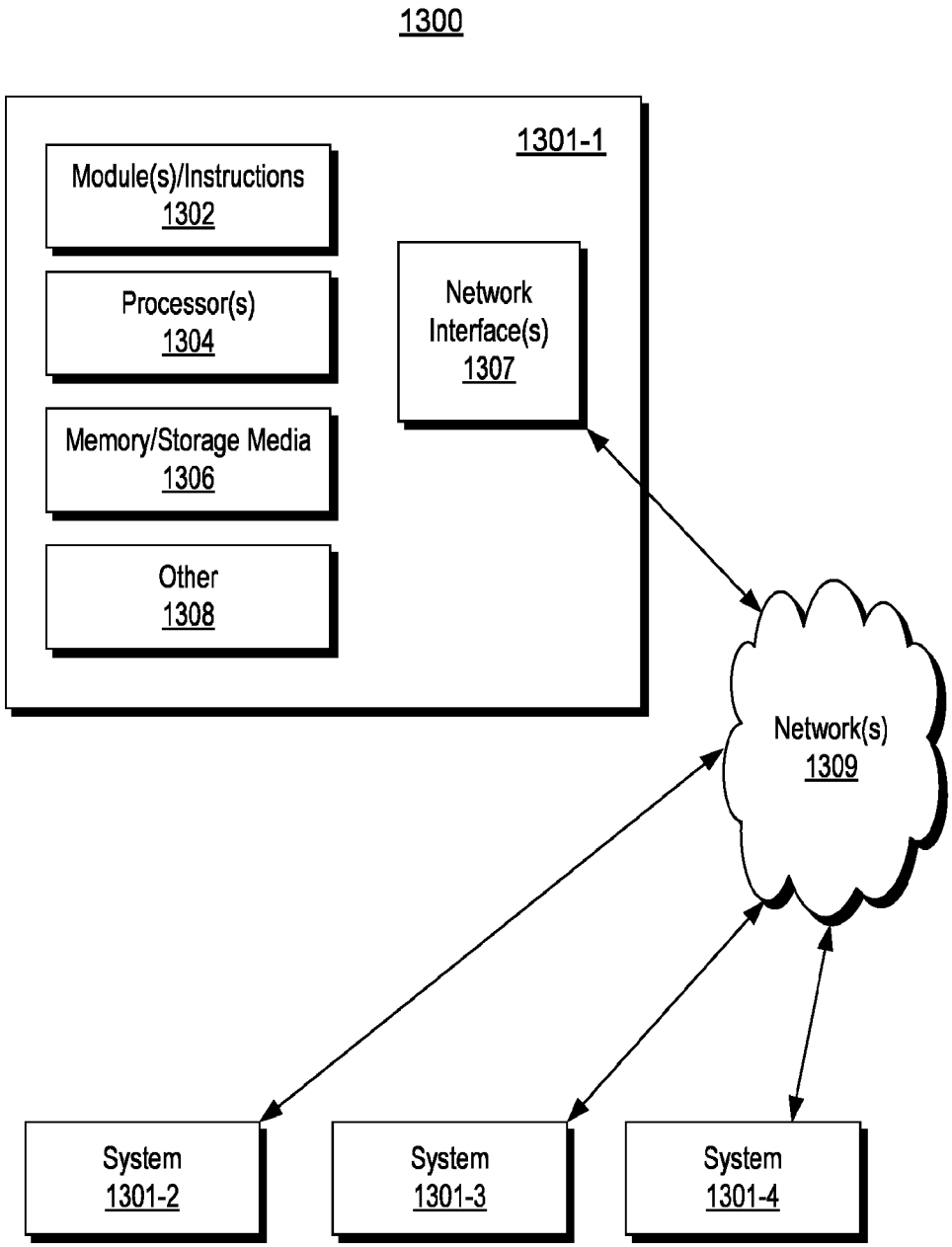
FIG. 13 illustrates an example of computing system.

In some embodiments, a method or methods may be executed by a computing system. FIG. 13 shows an example of a system 1300 that can include one or more computing systems 1301-1, 1301-2, 1301-3 and 1301-4, which may be operatively coupled via one or more networks 1309, which may include wired and/or wireless networks.

As an example, a system can include an individual computer system or an arrangement of distributed computer systems. In the example of FIG. 13, the computer system 1301-1 can include one or more modules 1302, which may be or include processor-executable instructions, for example, executable to perform various tasks (e.g., receiving information, requesting information, processing information, simulation, outputting information, controlling, etc.).

As an example, a module may be executed independently, or in coordination with, one or more processors 1304, which is (or are) operatively coupled to one or more storage media 1306 (e.g., via wire, wirelessly, etc.). As an example, one or more of the one or more processors 1304 can be operatively coupled to at least one of one or more network interface 1307. In such an example, the computer system 1301-1 can transmit and/or receive information, for example, via the one or more networks 1309 (e.g., consider one or more of the Internet, a private network, a cellular network, a satellite network, etc.).

As an example, the computer system 1301-1 may receive from and/or transmit information to one or more other devices, which may be or include, for example, one or more of the computer systems 1301-2, etc. A device may be located in a physical location that differs from that of the computer system 1301-1. As an example, a location may be, for example, a processing facility location, a data center location (e.g., server farm, etc.), a rig location, a wellsite location, a downhole location, etc.

As an example, a processor may be or include a microprocessor, microcontroller, processor module or subsystem, programmable integrated circuit, programmable gate array, or another control or computing device.

As an example, the storage media 1306 may be implemented as one or more computer-readable or machine-readable storage media. As an example, storage may be distributed within and/or across multiple internal and/or external enclosures of a computing system and/or additional computing systems.

As an example, a storage medium or storage media may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLUERAY disks, or other types of optical storage, or other types of storage devices.

As an example, a storage medium or media may be located in a machine running machine-readable instructions, or located at a remote site from which machine-readable instructions may be downloaded over a network for execution.

As an example, various components of a system such as, for example, a computer system, may be implemented in hardware, software, or a combination of both hardware and software (e.g., including firmware), including one or more signal processing and/or application specific integrated circuits.

As an example, a system may include a processing apparatus that may be or include a general purpose processors or application specific chips (e.g., or chipsets), such as ASICs, FPGAs, PLDs, or other appropriate devices.

Figure 14:
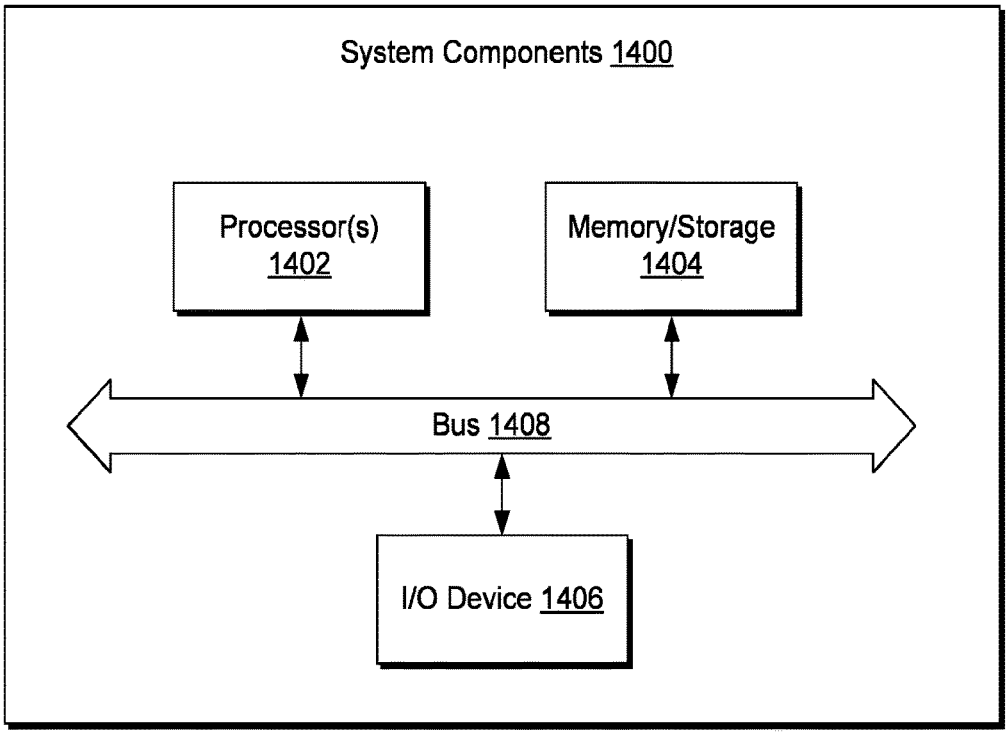
FIG. 14 illustrates example components of a system and a networked system.
Figure 14:
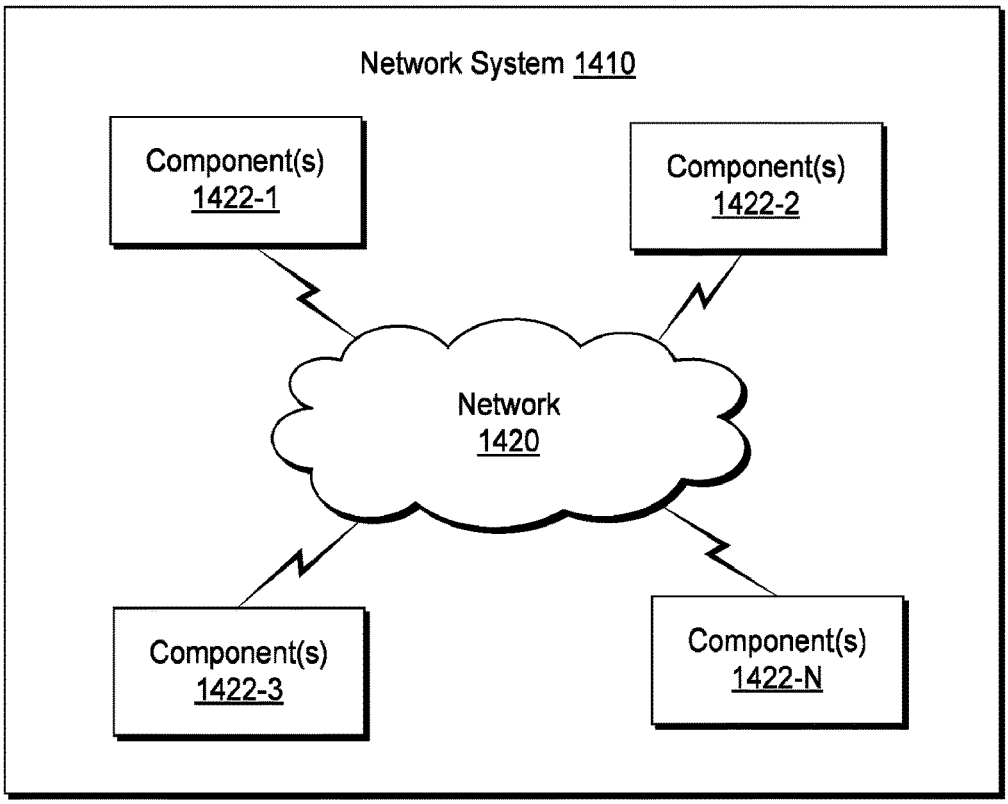

FIG. 14 shows components of a computing system 1400 and a networked system 1410 that includes a network 1420. The system 1400 includes one or more processors 1402, memory and/or storage components 1404, one or more input and/or output devices 1406 and a bus 1408. According to an embodiment, instructions may be stored in one or more computer-readable media (e.g., memory/storage components 1404). Such instructions may be read by one or more processors (e.g., the processor(s) 1402) via a communication bus (e.g., the bus 1408), which may be wired or wireless. The one or more processors may execute such instructions to implement (wholly or in part) one or more attributes (e.g., as part of a method). A user may view output from and interact with a process via an I/O device (e.g., the device 1406). According to an embodiment, a computer-readable medium may be a storage component such as a physical memory storage device, for example, a chip, a chip on a package, a memory card, etc.

According to an embodiment, components may be distributed, such as in the network system 1410. The network system 1410 includes components 1422-1, 1422-2, 1422-3, . . . 1422-N. For example, the components 1422-1 may include the processor(s) 1402 while the component(s) 1422-3 may include memory accessible by the processor(s) 1402. Further, the component(s) 1422-2 may include an I/O device for display and optionally interaction with a method. The network 1420 may be or include the Internet, an intranet, a cellular network, a satellite network, etc.

As an example, a device may be a mobile device that includes one or more network interfaces for communication of information. For example, a mobile device may include a wireless network interface (e.g., operable via IEEE 802.11, ETSI GSM, BLUETOOTH, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

As an example, a system may be a distributed environment, for example, a so-called "cloud" environment where various devices, components, etc. interact for purposes of data storage, communications, computing, etc. As an example, a device or a system may include one or more components for communication of information via one or more of the Internet (e.g., where communication occurs via one or more Internet protocols), a cellular network, a satellite network, etc. As an example, a method may be implemented in a distributed environment (e.g., wholly or in part as a cloud-based service).

As an example, information may be input from a display (e.g., consider a touchscreen), output to a display or both. As an example, information may be output to a projector, a laser device, a printer, etc. such that the information may be viewed. As an example, information may be output stereographically or holographically. As to a printer, consider a 2D or a 3D printer. As an example, a 3D printer may include one or more substances that can be output to construct a 3D object. For example, data may be provided to a 3D printer to construct a 3D representation of a subterranean formation. As an example, layers may be constructed in 3D (e.g., horizons, etc.), geobodies constructed in 3D, etc. As an example, holes, fractures, etc., may be constructed in 3D (e.g., as positive structures, as negative structures, etc.).

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

The invention claimed is:

1. A method comprising:

receiving block position data of a rig prior to addition of a length of pipe to a drillstring, wherein the drillstring is disposed at least in part in a borehole and supported by the rig;

receiving block position data of the rig after addition of the length of pipe to the drillstring; and controlling position of the drillstring with respect to time using the rig and at least a portion of the block position data for landing a drill bit of the drillstring on a bottom of the borehole, wherein controlling position of the drillstring with respect to time comprises controlling velocity of the drillstring in an in-hole direction based at least in part on a computed distance between the drill bit and the bottom of the borehole, wherein the computed distance is based at least in part on at least a portion of the block position data.

2. The method of claim 1, comprising receiving a signal indicative of slips status of slips that support the drillstring during an in-slips state.

3. The method of claim 1, wherein the block position data are received by an auto driller and wherein the auto driller performs the controlling.

4. The method of claim 1, wherein the controlling is performed without using a manually measured bit depth value.

5. The method of claim 1, wherein the controlling is performed without using a manually measured hole depth value.

6. The method of claim 1, wherein the controlling is performed without using a manually measured bit depth value and without using a manually measured hole depth value.

7. The method of claim 1, wherein the length of pipe is a length of a stand.

8. The method of claim 1, wherein the block position data comprise a reference block position value, an off-bottom block position value, and an in-slips added length of pipe block position value, wherein the controlling lands the drill bit on the bottom of the borehole by moving the drillstring a distance that corresponds to a block position determined at least in part by subtracting the off-bottom block position value from the in-slips added length of pipe block position value.

9. The method of claim 1, comprising receiving or determining a rate of penetration and controlling the position of the drillstring with respect to time based at least in part on the rate of penetration.

10. The method of claim 1, wherein the block position data of the rig, prior to addition of the length of pipe to the drillstring, comprises block position data for an on-bottom state of the drillstring that is prior to an in-slips state of the drillstring.

11. The method of claim 1, wherein the block position data of the rig after addition of the length of pipe to the drillstring is for an in-slips state and comprising transitioning the rig from the in-slips state to an out-of-slips state prior to the controlling.

12. The method of claim 1, further comprising controlling slips of the rig, wherein the controlling slips of the rig comprises a first transitioning from an out-of-slips state to an in-slips state and a second transitioning from the in-slips state to an out-of-slips state, wherein at least a portion of the block position data is acquired in the out-of-slips state and wherein at least a portion of the block position data is acquired in the in-slips state.

13. A system comprising:

a processor;

memory accessible by the processor;

processor-executable instructions stored in the memory and executable to instruct the system to:

receive block position data of a rig prior to addition of a length of pipe to a drillstring, wherein the drillstring is disposed at least in part in a borehole and supported by the rig;

receive block position data of the rig after addition of the length of pipe to the drillstring; and control position of the drillstring with respect to time using the rig and at least a portion of the block position data for landing a drill bit of the drillstring on a bottom of the borehole, wherein the block position data of the rig, prior to addition of the length of pipe to the drillstring, comprises block position data for an on-bottom state of the drillstring that is prior to an in-slips state of the drillstring.

14. The system of claim 13, wherein the block position data of the rig after addition of the length of pipe to the drillstring is for the in-slips state and comprising transitioning the rig from the in-slips state to an out-of-slips state prior to the controlling.

15. The system of claim 13, wherein controlling position of the drillstring with respect to time comprises controlling velocity of the drillstring in an in-hole direction based at least in part on a computed distance between the drill bit and the bottom of the borehole, wherein the computed distance is based at least in part on at least a portion of the block position data.

16. A non-transitory computer readable storage medium storing instructions that when executed by a computer, which includes a processor performs a method, the method comprising:

receiving block position data of a rig prior to addition of a length of pipe to a drillstring, wherein the drillstring is disposed at least in part in a borehole and supported by the rig;

receiving block position data of the rig after addition of the length of pipe to the drillstring; and controlling position of the drillstring with respect to time using the rig and at least a portion of the block position data for landing a drill bit of the drillstring on a bottom of the borehole, wherein controlling position of the drillstring with respect to time comprises controlling velocity of the drillstring in an in-hole direction based at least in part on a computed distance between the drill bit and the bottom of the borehole, wherein the computed distance is based at least in part on at least a portion of the block position data.

17. The non-transitory computer-readable storage medium of claim 16, wherein the block position data comprise a reference block position value, an off-bottom block position value, and an in-slips added length of pipe block position value, wherein the controlling lands the drill bit on the bottom of the borehole by moving the drillstring a distance that corresponds to a block position determined at least in part by subtracting the off-bottom block position value from the in-slips added length of pipe block position value.

18. The non-transitory computer-readable storage medium of claim 16, wherein the block position data of the rig, prior to addition of the length of pipe to the drillstring, comprises block position data for an on-bottom state of the drillstring that is prior to an in-slips state of the drillstring.

19. The non-transitory computer-readable storage medium of claim 16, wherein the block position data of the rig after addition of the length of pipe to the drillstring is for an in-slips state and comprising transitioning the rig from the in-slips state to an out-of-slips state prior to the controlling.

20. The non-transitory computer-readable storage medium of claim 16, further comprising controlling slips of the rig, wherein the controlling slips of the rig comprises a first transitioning from an out-of-slips state to an in-slips state and a second transitioning from the in-slips state to an out-of-slips state, wherein at least a portion of the block position data is acquired in the out-of-slips state and wherein at least a portion of the block position data is acquired in the in-slips state.

* * * * *